US010638900B2

(12) United States Patent
Hayamitsu

(10) Patent No.: US 10,638,900 B2
(45) Date of Patent: May 5, 2020

(54) AIR BLOWING DEVICE AND VACUUM CLEANER

(71) Applicant: Nidec Corporation, Kyoto (JP)

(72) Inventor: Ryosuke Hayamitsu, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 170 days.

(21) Appl. No.: 15/752,615

(22) PCT Filed: Aug. 24, 2016

(86) PCT No.: PCT/JP2016/074698
§ 371 (c)(1),
(2) Date: Feb. 14, 2018

(87) PCT Pub. No.: WO2017/043318
PCT Pub. Date: Mar. 16, 2017

(65) Prior Publication Data

US 2018/0235417 A1 Aug. 23, 2018

(30) Foreign Application Priority Data

Sep. 10, 2015 (JP) ..... 2015-178635
Nov. 9, 2015 (JP) ..... 2015-219104

(51) Int. Cl.
*A47L 9/00* (2006.01)
*F04D 29/44* (2006.01)
(Continued)

(52) U.S. Cl.
CPC ..... *A47L 9/00* (2013.01); *F04D 25/06* (2013.01); *F04D 25/0606* (2013.01);
(Continued)

(58) Field of Classification Search
CPC ..... A47L 9/00; A47L 9/22; A47L 5/28; A47L 5/24; A47L 7/04; F04D 25/06;
(Continued)

(56) References Cited

U.S. PATENT DOCUMENTS

2009/0246013 A1* 10/2009 Kenyon ..... A61M 16/0057 415/208.2
2012/0186036 A1* 7/2012 Kegg ..... A47L 5/22 15/347
2014/0056740 A1* 2/2014 Yim ..... F04D 25/0606 417/423.7

FOREIGN PATENT DOCUMENTS

EP 0 651 161 A1 5/1995
JP 59-213994 A 12/1984
(Continued)

OTHER PUBLICATIONS

Official Communication issued in International Patent Application No. PCT/JP2016/074698, dated Nov. 15, 2016.

*Primary Examiner* — Robert J Scruggs
(74) *Attorney, Agent, or Firm* — Keating & Bennett

(57) ABSTRACT

An air blowing device includes a motor, a ring-shaped cover, an impeller, and an impeller housing. The impeller includes a base portion and moving blades. The impeller housing includes an exhaust air guide portion. The ring-shaped cover includes a ring-shaped cover upper face portion and a ring-shaped cover outer edge portion having faces disposed across a gap that configures a flow path through which a fluid is guided. The gap has a first width where a distance between the faces is shortest, and which is smaller than a flow-in opening width where the fluid flows into the gap and a flow-out opening width where the fluid flows out.

17 Claims, 16 Drawing Sheets

(51) Int. Cl.

| | |
|---|---|
| ***F04D 25/06*** | (2006.01) |
| ***F04D 25/08*** | (2006.01) |
| ***F04D 29/28*** | (2006.01) |
| ***F04D 29/42*** | (2006.01) |

(52) U.S. Cl.
CPC ..... *F04D 25/08* (2013.01); *F04D 25/082* (2013.01); *F04D 29/281* (2013.01); *F04D 29/4206* (2013.01); *F04D 29/44* (2013.01); *F04D 29/441* (2013.01)

(58) Field of Classification Search
CPC .... F04D 25/08; F04D 29/281; F04D 29/4206; F04D 29/441
See application file for complete search history.

(56) References Cited

FOREIGN PATENT DOCUMENTS

| | | | |
|---|---|---|---|
| JP | 60-233396 | A | 11/1985 |
| JP | 11-125198 | A | 5/1999 |
| JP | 2005-226608 | A | 8/2005 |
| JP | 2006-250016 | A | 9/2006 |
| JP | 2010-209770 | A | 9/2010 |
| JP | 2011-080427 | A | 4/2011 |

* cited by examiner

AIR BLOWING DEVICE AND VACUUM CLEANER

BACKGROUND OF THE INVENTION

1. Field of the Invention

The present disclosure relates to an air blowing device and a vacuum cleaner.

2. Description of the Related Art

Static pressure is required of an air blowing device installed in a vacuum cleaner. An example of an air blowing device has multiple bent portions at the outer peripheral side and base portion side of multiple air guides. It is described therein that this enables an electric blower with high blowing efficiency to be provided.

SUMMARY OF THE INVENTION

Air discharged from an impeller is discharged from the outer side of the impeller via multiple bent portions provided to a flow path connected within a bracket in the air blowing device. Multiple bent portions cannot be formed in an air blowing device with a short flow path, so air flowing through the flow path cannot be efficiently guided. Accordingly, air turbulence occurs within the flow path, and the blowing efficiency of the air blowing device deteriorates.

An air blowing device according to an exemplary embodiment of the present disclosure includes a motor having a shaft that is disposed following a central axis extending in a vertical direction, a ring-shaped cover that is disposed further to an upper side in an axial direction than the motor, an impeller fixed to the shaft, and an impeller housing that encompasses above the impeller and the outer side thereof in the radial direction. The impeller includes a base portion that spreads in a direction orthogonal to the shaft, and a plurality of moving blades that are connected to the base portion and arrayed in a peripheral direction. The impeller housing includes an exhaust air guide portion that extends toward an outer side in the radial direction and toward a lower side, at a side further outward from an outer edge of the impeller in the radial direction. The ring-shaped cover includes a ring-shaped cover upper face portion that spreads in a direction orthogonal to the shaft, and faces the base portion in the axial direction, a ring-shaped cover outer edge portion that is positioned further on the outer side from the outer edge of the impeller in the radial direction. An outer face of the ring-shaped cover outer edge portion and an inner face of the exhaust air guide portion are disposed across a gap, and the gap configures a flow path through which a fluid flowing in from the impeller is guided. The gap has a first width where a distance between the outer face of the ring-shaped cover outer edge portion and the inner face of the exhaust air guide portion is shortest, in a region further to the outer side from the radial-direction inner edge of the ring-shaped cover outer edge portion and further to the inner side from the radial-direction outer edge of the ring-shaped cover outer edge portion. The first width is smaller than a flow-in opening width where the fluid flows into the gap and a flow-out opening width where the fluid flows out from the gap.

The above and other elements, features, steps, characteristics and advantages of the present disclosure will become more apparent from the following detailed description of the preferred embodiments with reference to the attached drawings.

DETAILED DESCRIPTION OF THE PREFERRED EMBODIMENTS

Figure 1:
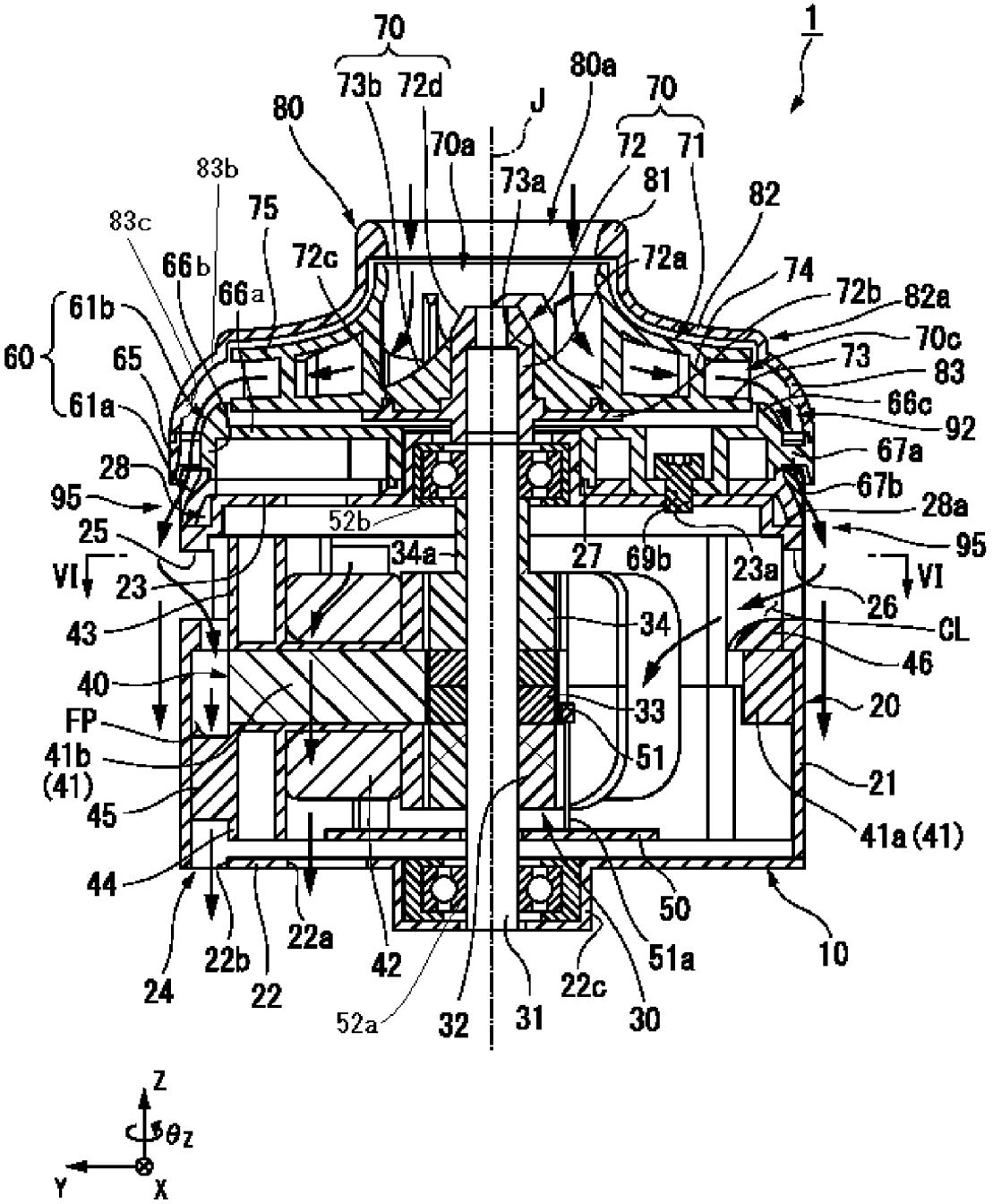
FIG. 1 is a cross-sectional view of an air blowing device according to an embodiment.

A motor according to an embodiment of the present disclosure will be described below with reference to the drawings. It should be noted that the scope of the present disclosure is not restricted by the following embodiments, and that modifications may be optionally made within the scope of the technical idea of the present disclosure. Further, in the following drawings, the scale and number and so forth of the structures may differ from that of the actual structures, in order to facilitate understanding of the configurations.

In the drawings, an XYZ coordinate system will be illustrated as a three-dimensional orthogonal coordinate system as appropriate. In the XYZ coordinate system, a Z-axis direction is a direction parallel to an axial direction along a central axis J illustrated in FIG. 1. An X-axis direction is a direction orthogonal to the Z-axis direction and is a right-left direction in FIG. 1. A Y-axis direction is a direction that is orthogonal to both of the X-axis direction and the Z-axis direction.

Also, in the following description, a direction (the Z-axis direction) in which the central axis J extends will be referred to as a vertical direction. The positive side in the Z-axis direction (+Z side) will be referred to as the "upper side (upper side in the axial direction)" and the negative side in the Z-axis direction (−Z side) will be referred to as the "lower side (lower side in the axial direction)". Note that the vertical direction, the upper side, and the lower side are terms that are used simply for the purpose of description and do not limit the actual positional relationship or direction. In addition, unless otherwise specifically noted, a direction (the Z-axis direction) parallel to the central axis J will be simply referred to as an "axial direction", a radial direction of which the central axis J is the center will be simply referred to as a "radial direction", and a circumferential direction around the central axis J will be simply referred to as a "circumferential direction".

Figure 2:
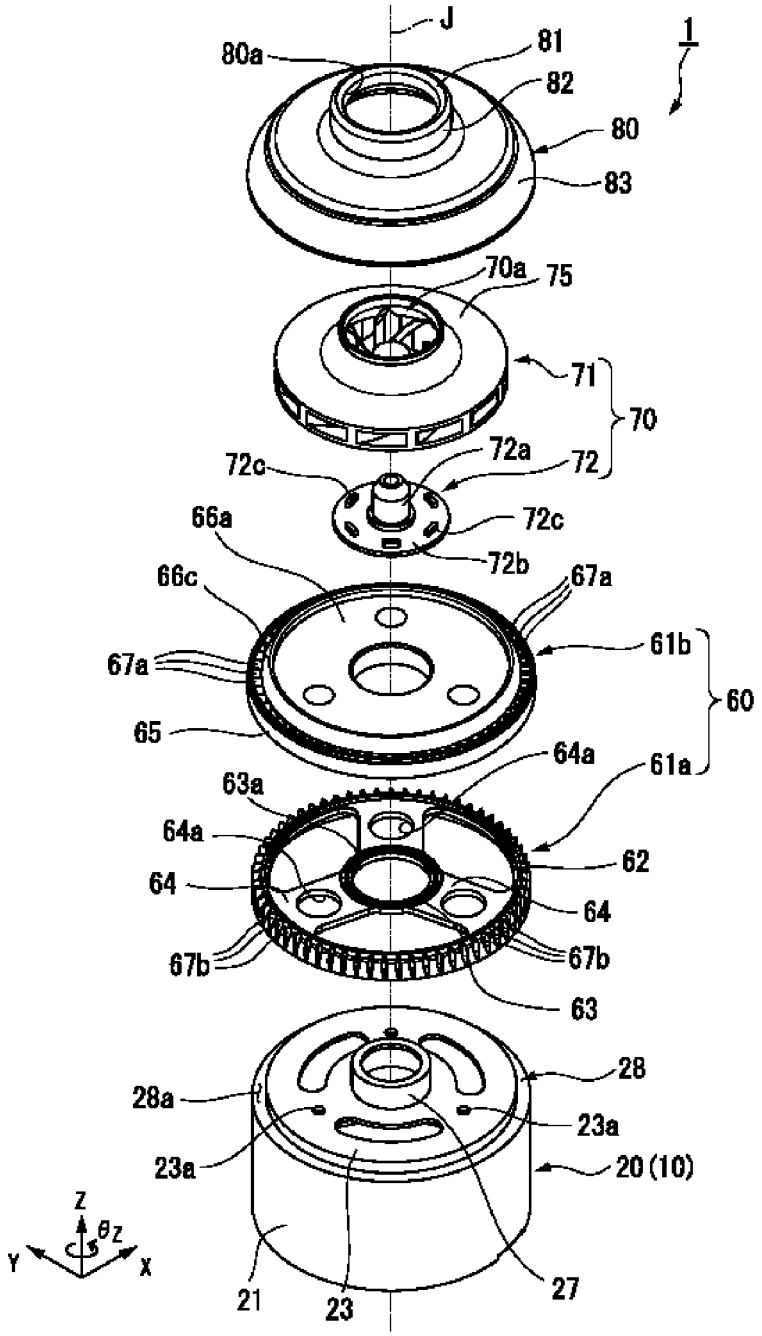
FIG. 2 is a disassembled perspective view of the air blowing device according to the embodiment.

FIG. 1 is a cross-sectional view of an air blowing device according to a first embodiment. FIG. 2 is a disassembled perspective view of the air blowing device according to the present embodiment.

An air blowing device 1 has a motor 10, an impeller 70, a stator vane member 60, and an impeller housing 80, as illustrated in FIG. 1 and FIG. 2. The stator vane member 60 is attached to the upper side (+Z side) of the motor 10. The impeller housing 80 is attached to the upper side of the stator vane member 60. The impeller 70 is accommodated between the stator vane member 60 and the impeller housing 80. The impeller 70 is attached to the motor 10 rotatably on the central axis J.

Figure 3:
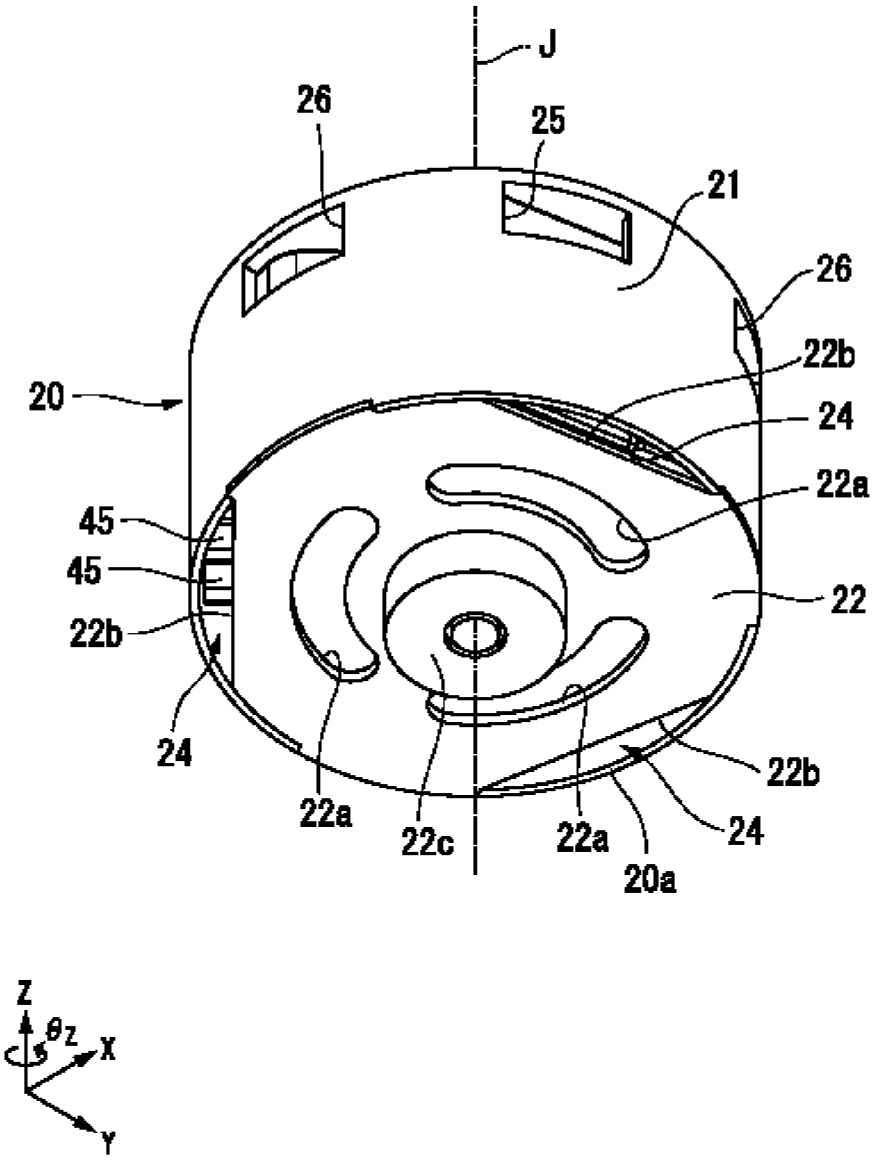
FIG. 3 is a perspective view of a motor according to the embodiment, as viewed from the lower side.

FIG. 3 is a perspective view of the motor according to the embodiment, as viewed from the lower side.

The motor 10 has a housing 20, a lower lid 22, a rotor 30 that has a shaft 31, a stator 40, a circuit board 50, a lower-side bearing 52*a*, and an upper-side bearing 52*b*, as illustrated in FIG. 1.

The housing 20 is a covered cylindrical container that accommodates the rotor 30 and stator 40. The housing 20 has a cylindrical peripheral wall 21, an upper lid portion 23 situated at the upper end of the peripheral wall 21, and an upper-side bearing holding portion 27 situated at the middle of the upper lid portion 23. The stator 40 is fixed on the inner side face of the housing 20. The upper-side bearing holding portion 27 is cylindrical in form and protrudes upwards from the middle of the upper lid portion 23. The upper-side bearing holding portion 27 holds the upper-side bearing 52*b* therein.

Housing-upper-portion through holes 25 and 26 that pass through the housing 20 in the radial direction are provided at the upper portion side of the peripheral wall of the housing 20, as illustrated in FIG. 1 and FIG. 3. Three housing-upper-portion through holes 25 and three housing-upper-portion through holes 26 are provided in the peripheral wall of the housing 20 in an alternating manner around the axis (see FIG. 6). According to this configuration, part of air discharged from later-described vents 95 flows into the housing 20, whereby a stator core 41 and coil 42 can be cooled. A stepped portion 28 encompassing the upper lid portion 23 around the axis is provided between the peripheral wall 21 and upper lid portion 23 of the housing 20.

The lower lid 22 is attached to a lower-side (−Z side) opening of the housing 20. A cylindrical lower-side bearing holding portion 22*c* that protrudes toward the lower side from the lower face of the lower lid 22 is provided at the middle of the lower lid 22. The lower-side bearing holding portion 22*c* holds the lower-side bearing 52*a*.

Arc-shaped through holes 22*a*, having a width in the radial direction, are provided to the lower lid 22 at three locations around the axis, as illustrated in FIG. 3. Notched portions 22*b* where the outer peripheral portion of the lower lid 22 has been linearly notched are provided at three positions on the outer peripheral edge of the lower lid 22. Gaps between the opening end 20*a* at the lower side of the housing 20 and the notched portions 22*b* are lower-side openings 24 of the motor 10.

The rotor 30 has the shaft 31, a rotor magnet 33, a lower-side magnet fixing member 32, and an upper-side magnet fixing member 34, as illustrated in FIG. 1. The rotor magnet 33 has a cylindrical shape, and encompasses the shaft 31 around the axis (θz direction) at the outer side in the radial direction. The lower-side magnet fixing member 32 and upper-side magnet fixing member 34 are cylindrical shapes, having a diameter equivalent to that of the rotor magnet 33. The lower-side magnet fixing member 32 and upper-side magnet fixing member 34 are attached to the shaft 31, sandwiching the rotor magnet 33 from both sides in the axial direction. The upper-side magnet fixing member 34 has a small radius portion 34*a* at the upper side portion in the central axis direction, of which diameter is smaller than the lower side (rotor magnet 33 side).

The shaft 31 is rotatably supported around the axis (θz direction) by the lower-side bearing 52*a* and upper-side bearing 52*b*. The impeller 70 is attached to the end of the shaft 31 at the upper side (+Z side). The impeller 70 integrally rotates with the shaft 31 on the axis.

Figure 4:
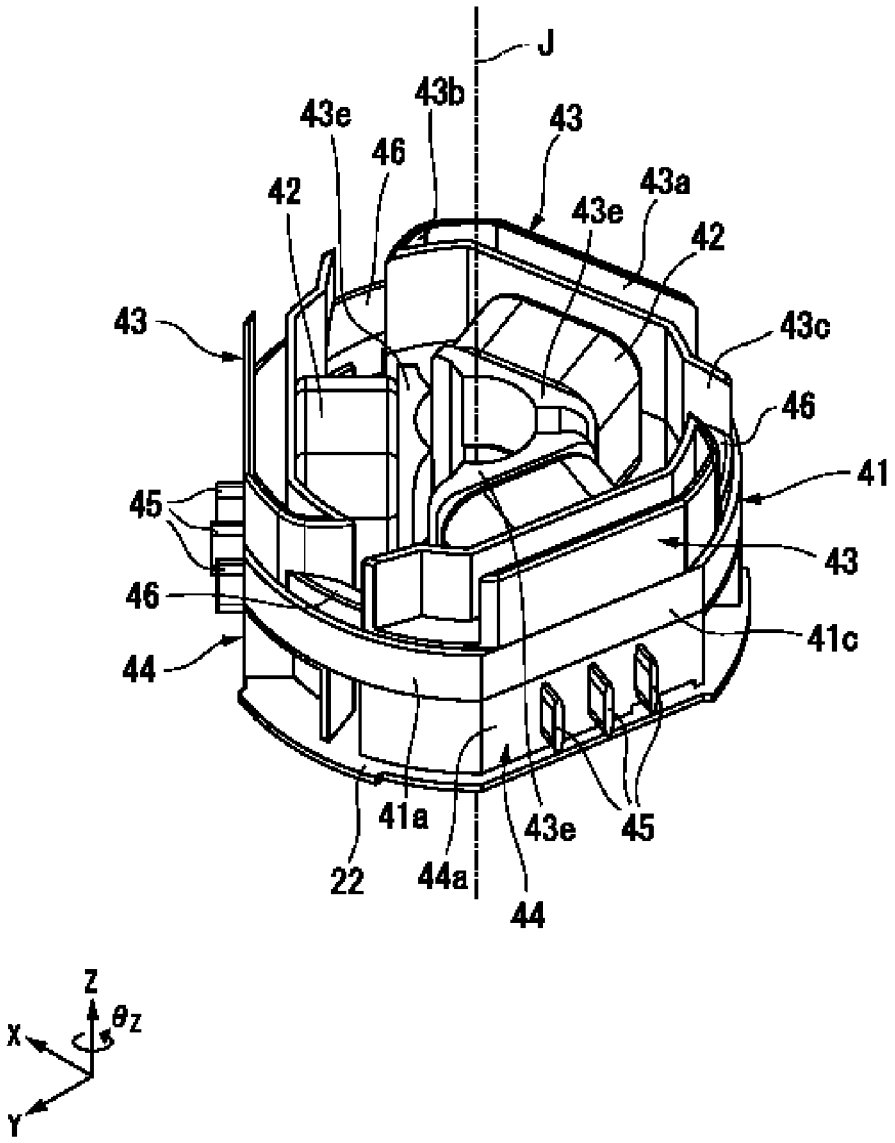
FIG. 4 is a perspective view of a stator according to the embodiment.
Figure 5:
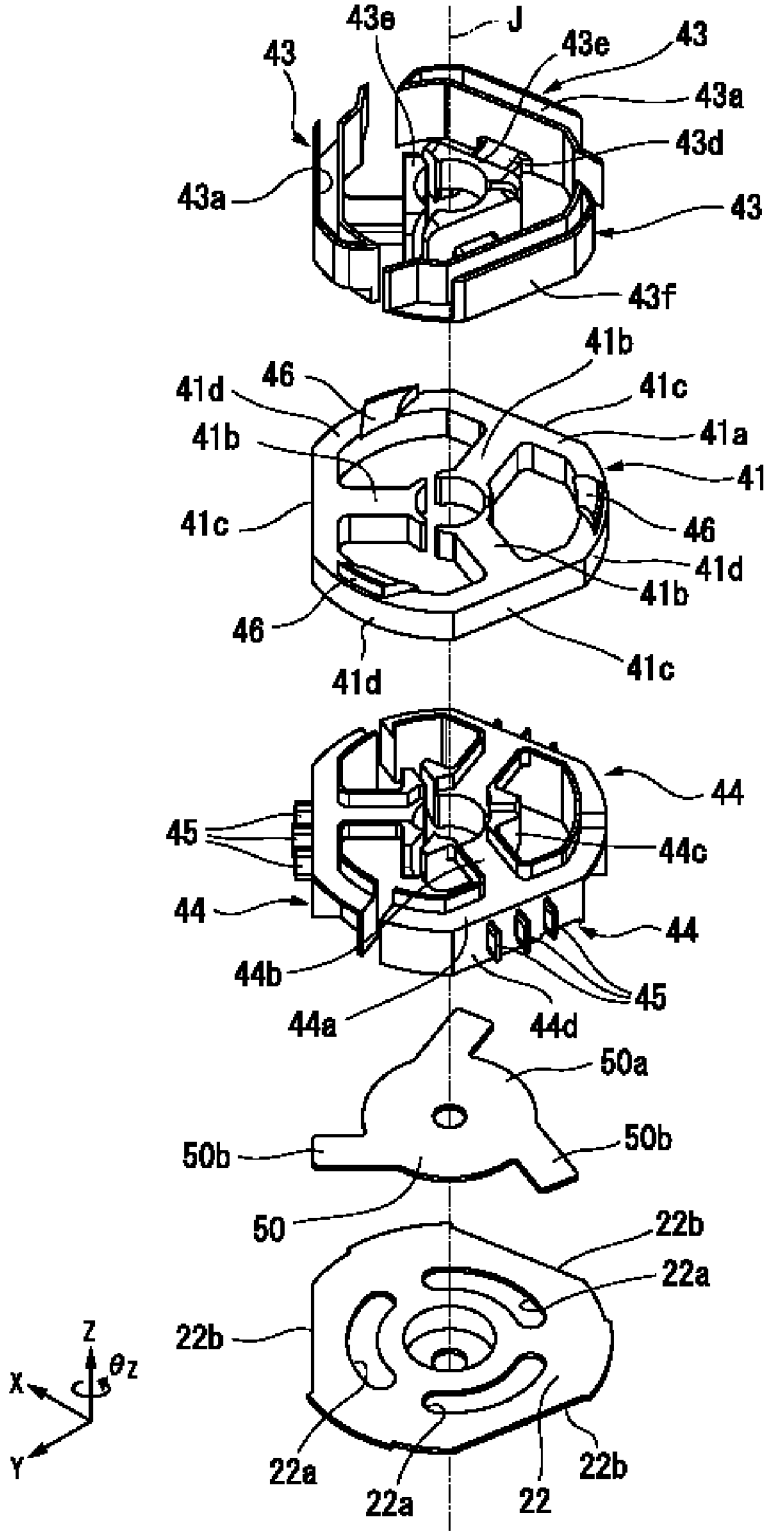
FIG. 5 is a disassembled perspective view illustrating a stator, a circuit board, and a lower lid.
Figure 6:
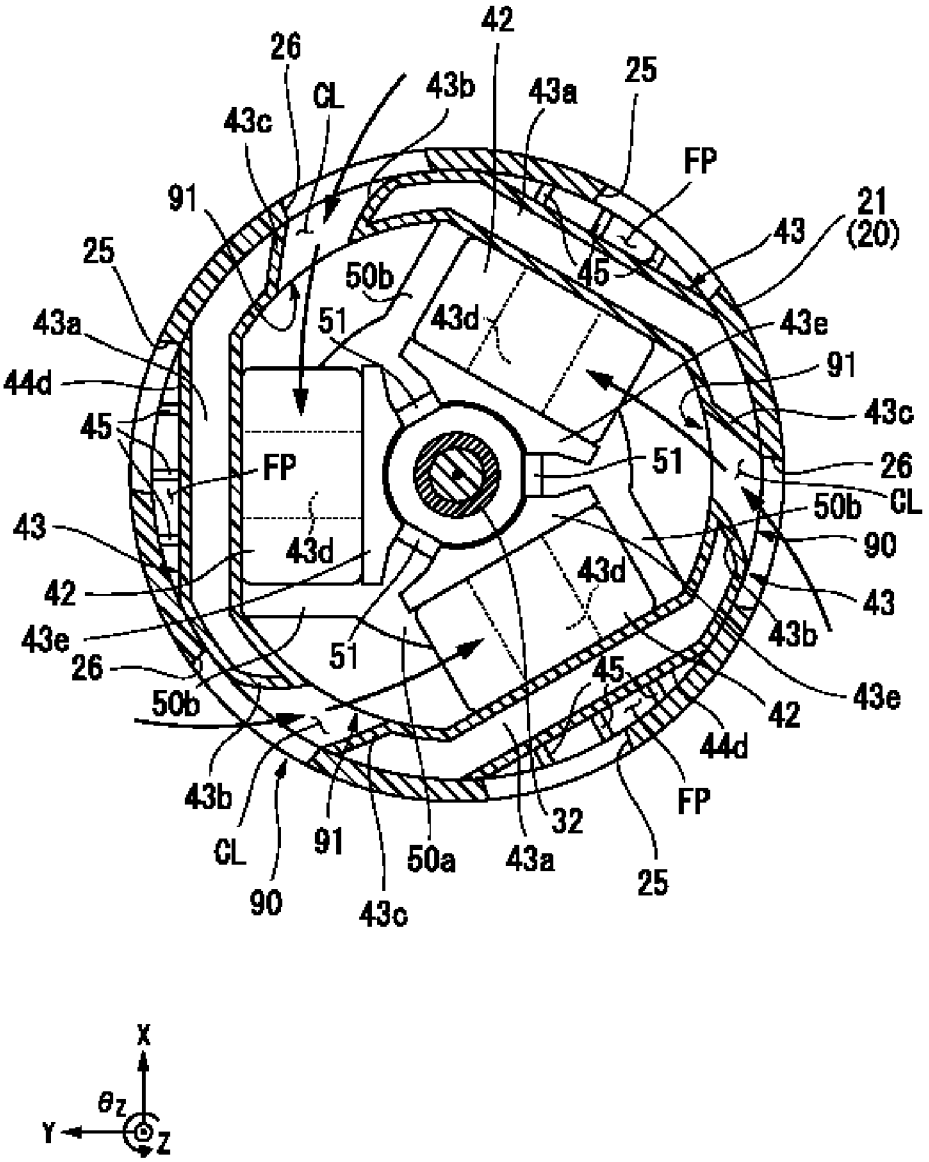
FIG. 6 is a plane cross-sectional view of the motor.

FIG. 4 is a perspective view of the stator 40 according to the present embodiment. FIG. 5 is a disassembled perspective view illustrating the stator 40, circuit board 50, and lower lid 22. FIG. 6 is a plane cross-sectional view of the motor 10.

The stator 40 is positioned on the outer side from the rotor 30 in the radial direction. The stator 40 encompasses the rotor 30 around the axis (θz direction). The stator 40 has a stator core 41, multiple (three) upper-side insulators 43, multiple (three) lower-side insulators 44, and coils 42, as illustrated in FIG. 4 and FIG. 5.

The stator core 41 includes a core back portion 41*a* and multiple (three) teeth portions 41*b*, as illustrated in FIG. 5. The core back portion 41*a* is ring-shaped around the center axis. The core back portion 41*a* has a configuration where linear portions 41*c* at three positions around the axis, and three arc portions 41*d*, are alternatingly positioned. The teeth portions 41*b* each extend inward in the radial direction from the inner peripheral face of the linear portions 41*c*. The teeth portions 41*b* are disposed equidistantly in the circumferential direction. An inclined member 46 that guides exhaust air into the stator 40 is disposed above each arc portion 41*d* of the core back portion 41*a*. The inclined members 46 have a shape where the thickness progressively becomes smaller from the outer side in the radial direction toward the inner side.

The upper-side insulators 43 are insulating members covering part of the upper face and side faces of the stator core 41. The upper-side insulators 43 are provided corresponding to each of the three teeth portions 41*b*. The upper-side insulators 43 each have an upper-side outer peripheral wall portion 43*a* that is positioned at the upper side of the core back portion 41*a*, an upper-side inner peripheral wall portion 43*e* that is positioned at the upper side of the tip of the teeth portion 41*b*, and an upper-side insulating portion 43*d* that links the upper-side outer peripheral wall portion 43*a* and upper-side inner peripheral wall portion 43*e* in the radial direction, and is positioned at the upper side of a portion of the teeth portion 41*b* where the coil is wound.

The lower-side insulators 44 are insulating members covering part of the lower face and side faces of the stator core 41. The lower-side insulators 44 are provided corresponding to each of the three teeth portions 41*b*. The lower-side insulators 44 each have a lower-side outer peripheral wall portion 44*a* that is positioned at the lower side of the core back portion 41*a*, a lower-side inner peripheral wall portion 44*c* that is positioned at the lower side of the tip of the teeth portion 41*b*, and a lower-side insulating portion 44*b* that links the lower-side outer peripheral wall portion 44*a* and lower-side inner peripheral wall portion 44*c* in the radial direction, and is positioned at the lower side of a portion of the teeth portion 41*b* where the coil is wound.

The upper-side insulators 43 and lower-side insulators 44 are disposed sandwiching the teeth portions 41*b* of the stator core 41 in the vertical direction. The coils 42 are wound on the teeth portions 41*b* covered by the upper-side insulating portions 43*d* of the upper-side insulators 43 and the lower-side insulating portions 44*b* of the lower-side insulators 44.

The three upper-side outer peripheral wall portions 43*a* positioned above the core back portion 41*a* of the stator core 41 encompass the coils 42, at the upper side of the stator core 41. The upper-side outer peripheral wall portions 43*a* each have a first side end face 43*b* and a second side end face 43*c* at both ends in the peripheral direction. The first side end faces 43*b* are inclined faces inclined in the radial direction and facing outwards in the radial direction. The second side end faces 43*c* are inclined faces inclined in the radial direction and facing inwards in the radial direction. Of the outer peripheral faces of the upper-side outer peripheral wall portions 43*a*, portions situated above the linear portions 41*c* are upper-side flat faces 43*f* extending in the axial direction matching the outer peripheral face of the linear portions. Arc-shaped faces disposed following the inner peripheral face of the housing 20 are disposed on both sides of the upper-side flat faces 43*f* in the peripheral direction.

The upper-side outer peripheral wall portions 43*a* that are adjacent in the circumferential direction are separated from each other by predetermined gaps, as illustrated in FIG. 6. Among adjacent upper-side outer peripheral wall portions 43*a*, the first side end face 43*b* of one upper-side outer peripheral wall portion 43*a* and the second side end face 43*c* of the other upper-side outer peripheral wall portion 43*a* face each other in the circumferential direction. The degree of inclination of the first side end face 43*b* in the radial direction and the degree of inclination of the second side end face 43*c* in the radial direction differ. More specifically, the width of opening portions 90 at the outer side in the radial direction from gaps CL formed between adjacent upper-side outer peripheral wall portions 43*a* in the peripheral direction is narrower than the width in the peripheral direction of opening portions 91 at the inner side in the radial direction.

Below the gaps CL are situated the inclined members 46 disposed above the core back portion 41*a*. The inclined members 46 are sandwiched between the first side end faces 43*b* and second side end faces 43*c*. The gaps CL are situated on the inner side of the housing-upper-portion through holes 26 of the housing 20. The housing-upper-portion through holes 26 and the gaps CL make up airflow paths guiding exhaust air flowing in from the outer side of the housing 20 to the inner side of the stator 40. The direction of inclination of the gaps CL in the radial direction as viewed from above (the direction from the outer side in the radial direction toward the inner side) matches the direction of flow of exhaust air discharged from the stator vane member 60 in the peripheral direction. That is to say, this matches the direction of rotation of the impeller 70.

The opening portions 90 at the inlet side of the gaps CL are formed relatively large, so a greater amount of exhaust air can be suctioned in from the housing-upper-portion through holes 26, while the widths of the opening portions 91 are relatively narrow, so air discharged from the gaps CL can be caused to flow to the intended positions (coils 42) more accurately, as illustrated in FIG. 6. Accordingly, the stator core 41 and coils 42 can be cooled more efficiently by the air flowing in from the housing-upper-portion through holes 26.

The three lower-side outer peripheral wall portions 44*a* positioned at the lower side from the core back portion 41*a* encompass the coils 42 at the lower side of the stator core 41. Although there are gaps between lower-side outer peripheral wall portions 44*a* that are adjacent in the circumferential direction, the lower-side outer peripheral wall portions 44*a* may be in contact with each other in the circumferential direction. Of the outer peripheral faces of the lower-side outer peripheral wall portions 44*a*, the portions positioned at the lower side from the linear portions 41*c* of the core back portion 41*a* are lower-side flat faces 44*d* extending in the axial direction matching the outer peripheral face of the linear portions 41*c*. At both sides in the peripheral direction of the lower-side flat faces 44*d*, arc-shaped faces are provided having been disposed following the inner peripheral face of the housing 20.

Multiple (three in the illustration) plate portions 45 that extend in the axial direction are provided to the lower-side flat faces 44*d*. The plate portions 45 are erected approximately perpendicular to the lower-side flat faces 44*d*, as illustrated in FIG. 6. The tips of the plate portions 45 at the outer side in the radial direction reach the inner peripheral face of the housing 20. The plate portions 45 section the region between the lower-side outer peripheral wall portion 44*a* and the housing 20 into multiple regions in the circumferential direction.

The circuit board 50 is disposed between the stator 40 and the lower lid 22, as illustrated in FIG. 1 and FIG. 6. The circuit board 50 has a circular ring-shaped main unit portion 50*a*, and three protruding portions 50*b* that protrude toward the outer side from the outer edge of the main unit portion 50*a*, in a direction inclined as to the radial direction. The main unit portion 50*a* has a hole through which the shaft 31 is passed. The circuit board 50 is fixed to the lower-side insulators 44.

The circuit board 50 has at least three rotary sensors 51 mounted thereupon, as illustrated in FIG. 6. The rotary sensors 51 are Hall effect sensors, for example. The circuit board 50 may be electrically connected to the coils 42. In this case, a driving circuit that outputs driving signals to the coils 42 may be mounted on the circuit board 50.

Figure 7:
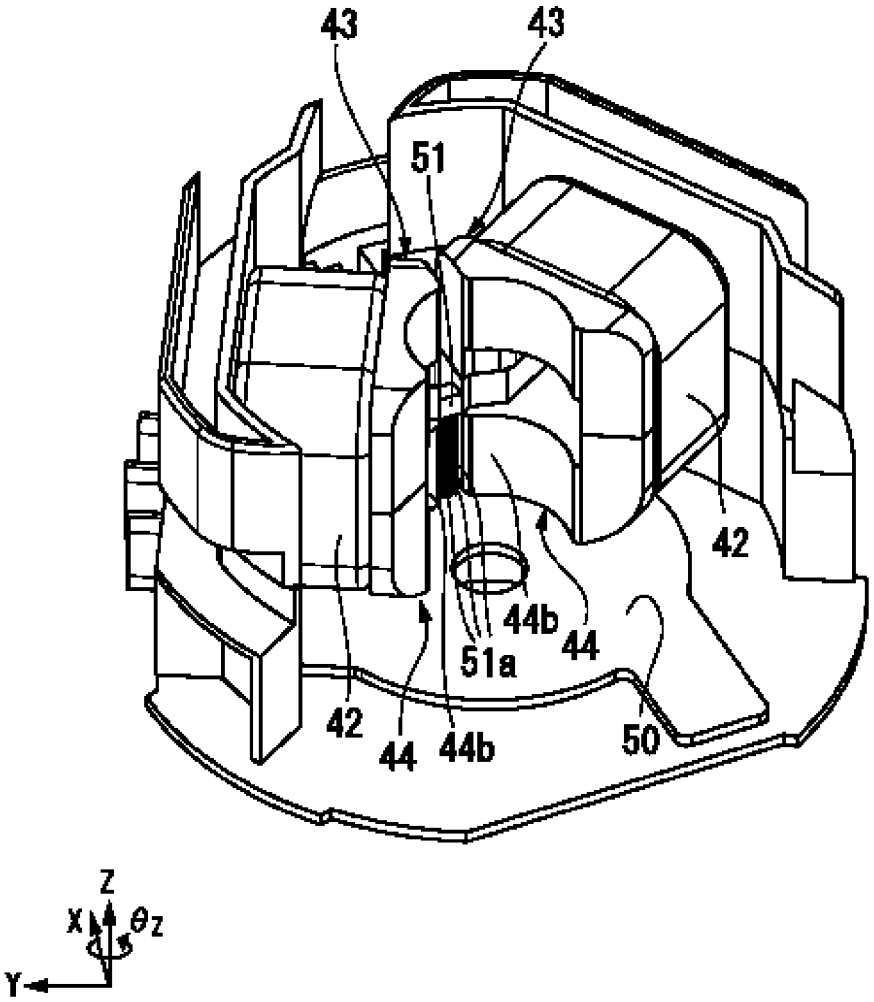
FIG. 7 is an explanatory diagram illustrating a mounted form of a rotation sensor.

FIG. 7 is an explanatory diagram illustrating a mounting state of a rotary sensor 51.

The rotary sensors 51 are disposed interposed between tip portions of lower-side inner peripheral wall portions 44*c* that are adjacent in the circumferential direction, as illustrated in FIG. 6 and FIG. 7. The three rotary sensors 51 are equidistantly disposed every 120° in the circumferential direction. The faces of the rotary sensors 51 on the inner side in the radial direction face the rotor magnet 33. The rotor magnet 33 is disposed at the center portion of the rotor 30 in the axial direction in the case of the present embodiment. Accordingly, the rotary sensors 51 are connected to the circuit board 50 by leads 51*a* of a length corresponding to the length from the circuit board 50 to the rotor magnet 33 in the axial direction. The length of the motor 10 in the axial direction can be reduced by three rotary sensors 51 being disposed interposed between the tip portions of lower-side inner peripheral wall portions 44*c* that are adjacent in the circumferential direction, as compared to a structure where sensor magnets are disposed below the lower-side magnet fixing member 32 and the rotary sensors 51 are disposed further below the sensor magnets, for example.

A mechanism that supports the rotary sensors 51 may be provided to the tip portion of the lower-side inner peripheral wall portions 44*c*. For example, recesses may be provided into which the rotary sensors 51 are inserted, thereby suppressing movement of the rotary sensors 51 in the radial direction. Alternatively, the rotary sensors 51 may be fixed to the lower-side inner peripheral wall portions 44*c* by snap-fitting or the like.

The lower lid 22 is attached to the opening end 20*a* of the housing 20 accommodating the stator 40 and circuit board 50. At least part of the three through holes 22*a* of the lower lid 22 are situated further on the outer side in the radial direction than the outer peripheral edge of the main unit portion 50*a* of the circuit board 50.

The notched portions 22*b* at the outer periphery of the lower lid 22 are disposed approximately matching the linear portions 41*c* of the stator core 41, the upper-side flat faces 43*f* of the upper-side insulators 43, and the lower-side flat faces 44*d* of the lower-side insulators 44, as viewed in the axial direction. The lower-side openings 24 at the lower face of the motor 10 serve as vents of the air flow paths FP between the stator 40 and housing 20.

Next, the stator vane member 60, impeller 70, and impeller housing 80 will be described.

Figure 8:
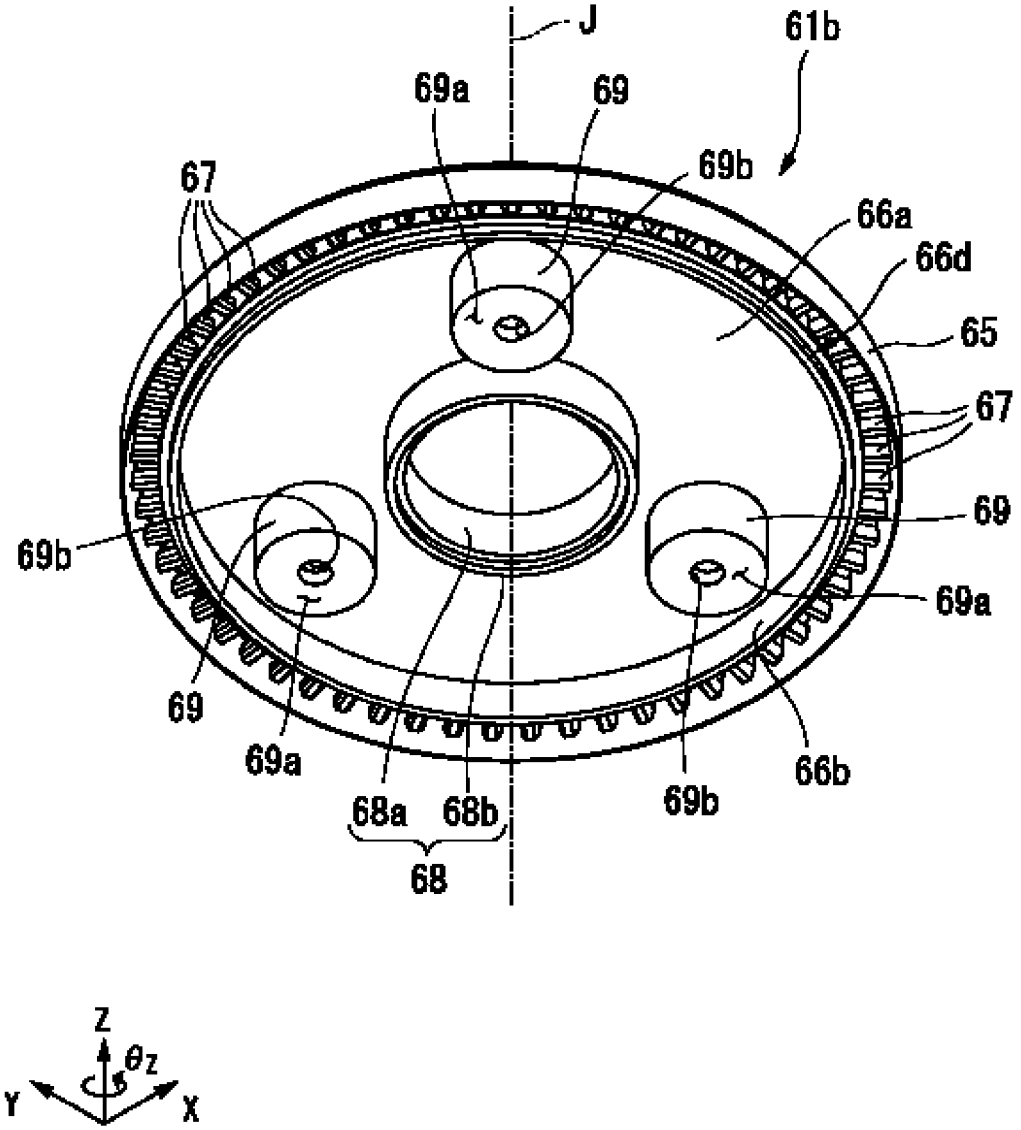
FIG. 8 is a perspective view of a stator vane member as viewed from below.
Figure 9:
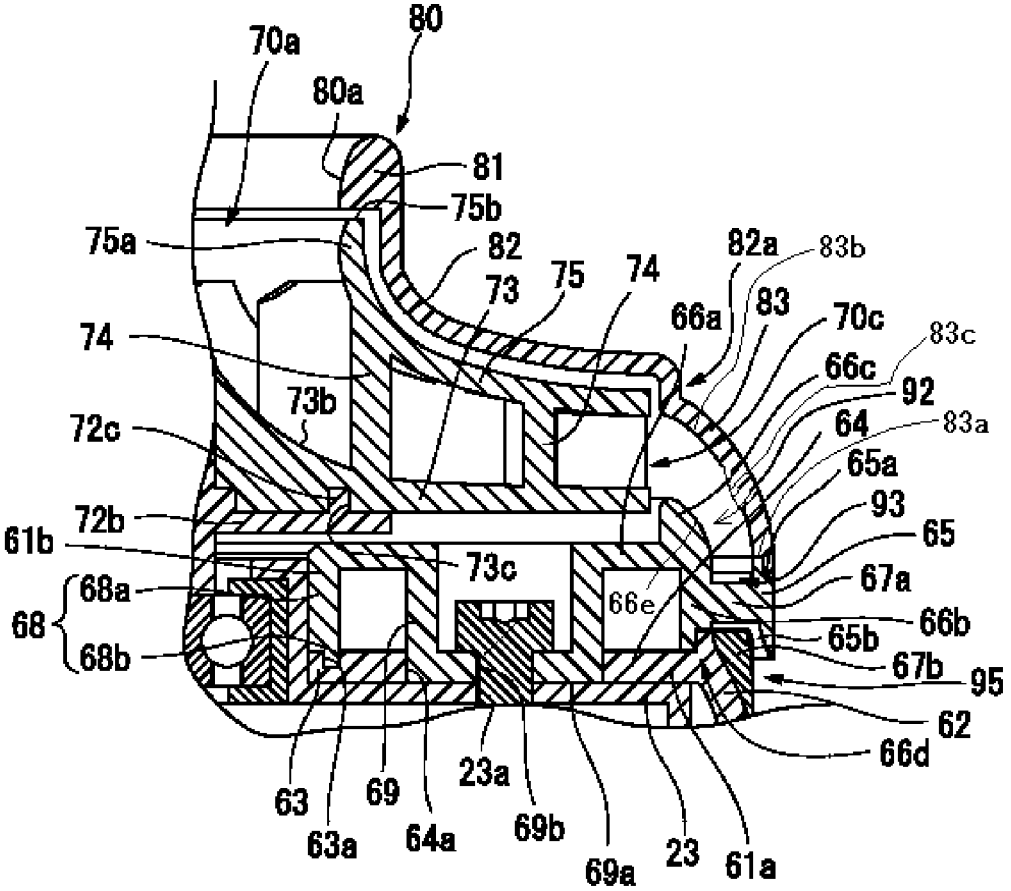
FIG. 9 is a cross-sectional view where a part of the impeller, stator vane member, and impeller housing are illustrated enlarged.
Figure 10:
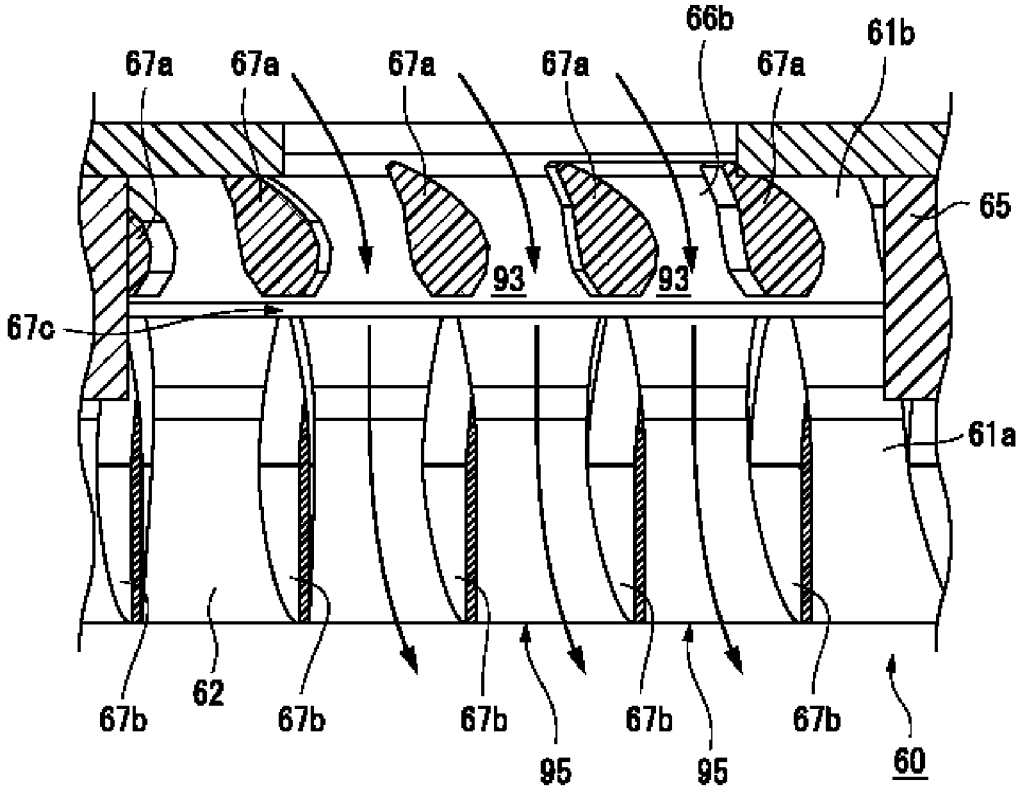
FIG. 10 is a partial side view of a stator vane member.

FIG. 8 is a perspective view of the stator vane member 60 as viewed from below. FIG. 9 is a cross-sectional view where a part of the impeller 70, stator vane member 60, and impeller housing 80 are illustrated enlarged. FIG. 10 is a partial side view of the stator vane member 60.

The stator vane member 60 has a first stator vane member 61*a*, and a ring-shaped cover portion 61*b*, as illustrated in FIG. 1 and FIG. 2. The first stator vane member 61*a* and ring-shaped cover portion 61*b* are attached to the upper face of the motor 10, having been layered in the axial direction.

The first stator vane member 61*a* has a lower-portion stator vane supporting ring 62, an attachment ring 63, three linking portions 64, and multiple lower-portion stator vanes 67*b*. The lower-portion stator vane supporting ring 62 and attachment ring 63 are disposed coaxially, and are linked by the three linking portions 64 extending in the radial direction. The three linking portions 64 are disposed at equidistant intervals of 120° each in the peripheral direction. The linking portions 64 have through holes 64*a* that pass through in the axial direction. Three through holes 64*a* are disposed at equidistant intervals of 120° each in the peripheral direction. The attachment ring 63 has a recessed groove 63*a* on the upper face thereof, that is concentric with the attachment ring 63.

The multiple lower-portion stator vanes 67*b* protrude toward the outer side in the radial direction from the outer peripheral face of the lower-portion stator vane supporting ring 62. The multiple lower-portion stator vanes 67*b* are disposed equidistantly in the peripheral direction. The outer peripheral face of the lower-portion stator vane supporting ring 62 is a tapered form that tapers toward the upper side. The lower-portion stator vanes 67*b* have shapes that increase in width in the radial direction the further toward the upper side.

The ring-shaped cover portion 61*b* has a disc-ring shaped ring-shaped cover flat face portion 66*a*, a cylindrical upper-portion stator vane supporting ring 66*b* extending to the lower side form the outer peripheral edge of the ring-shaped-cover flat portion 66*a*, multiple upper-portion stator vanes 67*a*, an outer perimeter ring 65 connected to the outer side of the upper-portion stator vanes 67*a* ion the radial direction, and a ring-shaped protruding portion 66*c* that protrudes upward from the outer peripheral edge of the ring-shaped cover flat face portion 66*a*. The multiple upper-portion stator vanes 67*a* link the outer peripheral face of the upper-portion stator vane supporting ring 66*b* and the inner peripheral face of the outer perimeter ring 65. The upper-portion stator vane supporting ring 66*b* has a stepped portion 66*d* that extends the full circumference of the outer peripheral side of the lower end portion thereof.

The ring-shaped cover flat face portion 66*a* has an attachment ring 68 that extends downwards from the lower face at the middle portion, and three columnar protruding portions 69 that protrude downwards from the lower face of the ring-shaped-cover flat portion 66*a*, as illustrated in FIG. 8. The attachment ring 68 has a cylindrical cylinder portion 68*a*, and a ring-shaped protruding portion 68*b* that protrudes downwards from the outer peripheral portion in the radial direction of the lower end face of the cylinder portion 68*a*. The three columnar protruding portions 69 have the same diameters and heights, and are equidistantly disposed every 120° in the circumferential direction. The columnar protruding portions 69 are hollow in the present embodiment, and each have a through hole 69*b* at the middle of an end face 69*a* at the lower side that passes through in the axial direction.

The upper-side bearing holding portion 27 of the motor 10 is inserted into the attachment ring 63 of the first stator vane member 61*a*, as illustrated in FIG. 1 and FIG. 9. The lower end face of the lower-portion stator vane supporting ring 62 of the first stator vane member 61*a* comes into contact with a stepped face 28*a* facing upwards on the stepped portion 28 of the motor 10.

The ring-shaped cover portion 61*b* is attached to the first stator vane member 61*a*. The upper-side bearing holding portion 27 is inserted into the attachment ring 68 of the ring-shaped cover portion 61*b*, as illustrated in FIG. 9. The protruding portion 68*b* at the lower side tip of the attachment ring 68 is fit into the recessed groove 63*a* of the first stator vane member 61*a*. The stepped portion 66*d* of the upper-portion stator vane supporting ring 66*b* of the ring-shaped cover portion 61*b* is fit to an upper side opening end of the lower-portion stator vane supporting ring 62. The outer peripheral face of the upper-portion stator vane supporting ring 66*b* and the outer peripheral face of the lower-portion stator vane supporting ring 62 are smoothly connected in the vertical direction.

The columnar protruding portions 69 of the ring-shaped cover portion 61*b* are inserted into the through holes 64*a* of the first stator vane member 61*a*. The end faces 69*a* of the columnar protruding portions 69 come into contact with the upper face of the upper lid portion 23 of the motor 10. The ring-shaped cover portion 61*b* and the motor 10 are fastened to each other, by bolts BT inserted through the through holes 69*b* of the columnar protruding portions 69 and screw holes 23*a* of the upper lid portion 23. The first stator vane member 61*a* is positioned in the peripheral direction by the columnar protruding portions 69 of the ring-shaped cover portion 61*b*, and is fixed to the motor 10 by being pressed by the attachment ring 68 and upper-portion stator vane supporting ring 66*b* of the ring-shaped cover portion 61*b*.

The stator vane member 61 is configured of two members (first stator vane member 61*a* and ring-shaped cover portion 61*b*), while only the ring-shaped cover portion 61*b* is fastened to the metal housing 20 of the motor 10 in the present embodiment. This fixing arrangement enables trouble to be suppressed from occurring in the state of fastening between the motor 10 and stator vane member 60 when change in temperature of the air blowing device 1 occurs.

Specifically, in an assumed case where both of the first stator vane member 61*a* and ring-shaped cover portion 61*b* are fixed to the motor 10 by common bolts BT being passed through, the bolts BT fasten down the two resin members, and the amount of change in volume due to temperature change increases. Accordingly, there is concern that the stator vane member 60 will shrink in low-temperature environments, creating looseness. In comparison with this, in the present embodiment, the end faces 69*a* of the columnar protruding portions 69 of the ring-shaped cover portion 61*b* are brought into contact with the housing 20 and fastened by the bolts BT, so the thickens of the resin member fastened by the bolts BT can be reduced. Accordingly, the amount of change in volume when temperature changes is smaller, thereby enabling loosening of the fastening to be suppressed.

FIG. 10 is a side view of the stator vane member 60.

The same number of upper-portion stator vanes 67*a* and lower-portion stator vanes 67*b* are arrayed in the peripheral direction, as illustrated in FIG. 10. The upper-portion stator vanes 67*a* and lower-portion stator vanes 67*b* correspond one on one, and are disposed arrayed in the axial direction. In the case of the present embodiment, the angle of inclination as to the axial direction of the upper-portion stator vanes 67*a* is greater than the angle of inclination as to the axial direction of the lower-portion stator vanes 67*b*. The upper-portion stator vanes 67*a* are disposed inclined at a relatively great angle, in order to cause exhaust air that flows in a direction inclined to the rotation direction of the impeller 70 to efficiently flow in between the upper-portion stator vanes 67*a*. The lower-portion stator vanes 67*b* guide the exhaust air downwards, so that exhaust air discharged from the vents 95 does not flow outwards in the radial direction.

A gap 67*c* is a gap that extends in the horizontal direction in the present embodiment, but may be a gap that extends in an oblique direction as to the horizontal direction. In a case of a gap extending in an oblique direction, the direction preferably is the same as the direction of inclination of the upper-portion stator vanes 67*a*. Providing such an oblique-direction gap results in exhaust air passing through the gap, and an entire exhaust air flow path 93 can be effectively used.

The exhaust air flow path 93 shifts toward the outer side in the radial direction near the vents 95 in the present embodiment, as illustrated in FIG. 9. That is to say, the outer peripheral face of the lower-portion stator vane supporting ring 62 of the first stator vane member 61*a* is tapered in shape, with the diameter increasing toward the lower side. Of the outer perimeter ring 65 of the ring-shaped cover portion 61*b*, a lower ring 65*b* facing toward the lower-portion stator vane supporting ring 62 in the radial direction has a skirt-like shape where the inner circumference diameter increases toward the lower side. The exhaust air flow path 93 spreads more to the outer side in the radial direction the lower the position is, with the width in the radial direction unchanged. Thus, the horizontal cross-sectional area of the exhaust air flow path 93 gradually increases the closer to the vents 95. This enables exhaust noise at the time of air being discharged from the vents 95 to be reduced.

The impeller 70 discharges fluid suctioned from an intake port 70*a* that is opened toward the upper side, toward the outer side in the radial direction via internal flow paths. The impeller 70 has an impeller main body 71 and an impeller hub 72.

The impeller main body 71 has a base portion 73, multiple moving blades 74, and a shroud 75. The base portion 73 is disc-shaped, and has a through hole 73*a* passing through in the axial direction at the middle portion. The perimeter of the through hole 73*a* of the base portion 73 is an inclined portion 73*b* that has a conical face shape extending at the upper side. The moving blades 74 are plate-shaped members curved in the circumferential direction, that extend from the inner side in the radial direction toward the outer side on the upper face of the base portion 73. The moving blades 74 are disposed erected following the axial direction. The shroud 75 is a cylindrical shape that tapers toward the upper side in the axial direction. An opening portion at the middle of the shroud 75 is the intake port 70*a* of the impeller 70. The base portion 73 and shroud 75 are linked by the moving blades 74.

Figure 11:
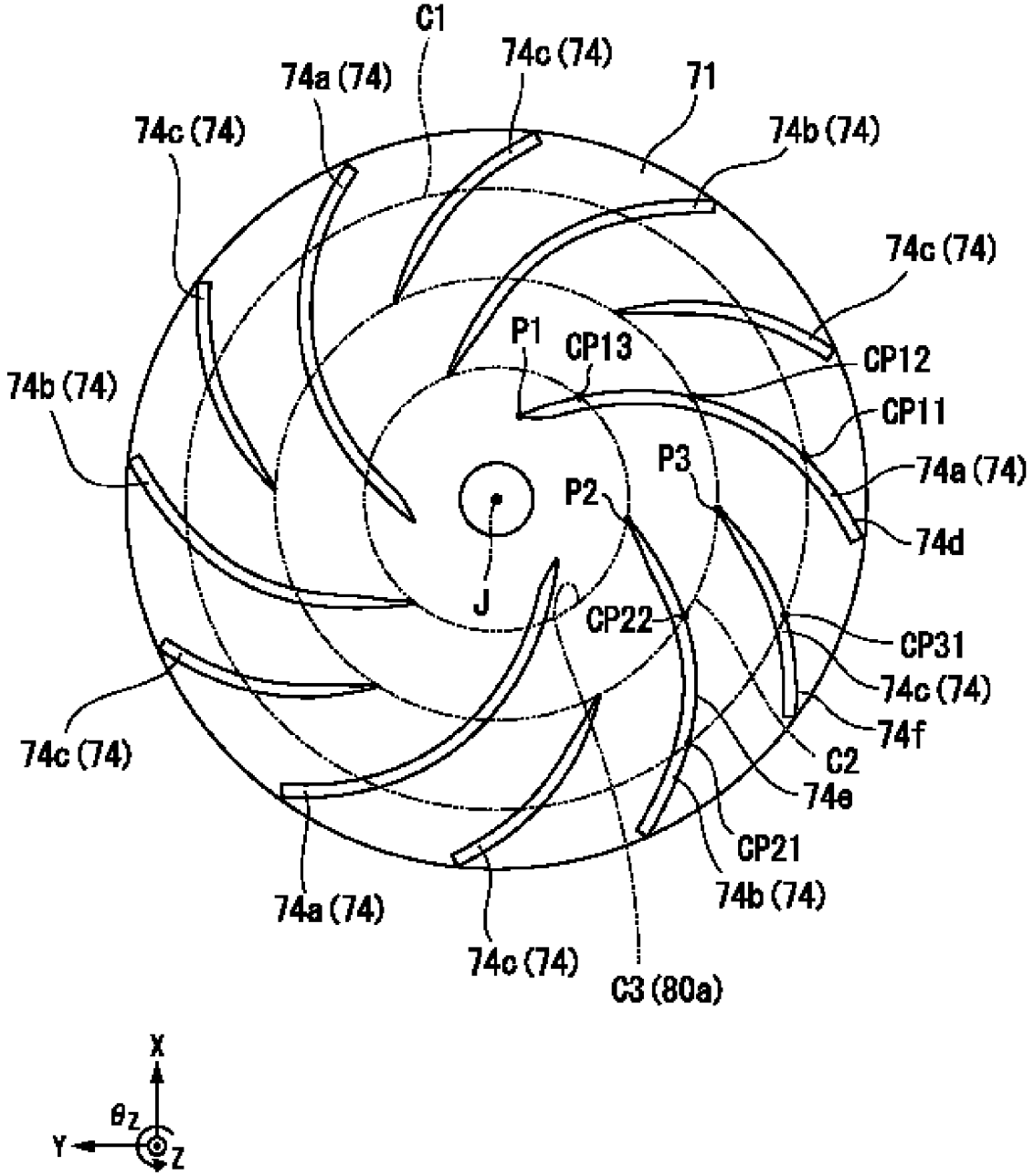
FIG. 11 is a plan view of moving blades of the impeller.

FIG. 11 is a plan view of the moving blades 74 of the impeller 70.

The multiple moving blades 74 are disposed following the circumferential direction (θz direction) on the upper face of the base portion 73, as illustrated in FIG. 11. The moving blades 74 are erected perpendicularly from the upper face of the base portion 73 following the axial direction, as illustrated in FIG. 1.

In the present embodiment, three types of moving blades 74 are disposed, with the same types of moving blades being equidistantly disposed in the circumferential direction. The multiple moving blades 74 in the present embodiment include multiple (three) first moving blades 74*a*, multiple (three) second moving blades 74*b*, and multiple (six) third moving blades 74*c*. The three first moving blades 74*a* are disposed at equidistantly every 120° in the circumferential direction. The second moving blades 74*b* are each disposed at intermediate positions between first moving blades 74*a* adjacent in the circumferential direction. The three second moving blades 74*b* are also disposed equidistantly every 120° in the circumferential direction. The third moving blades 74*c* are each disposed at intermediate positions between first moving blades 74*a* and second moving blades 74*b* adjacent in the circumferential direction. The six third moving blades 74*c* are disposed equidistantly every 60° in the circumferential direction.

The moving blades 74 extend on the upper face of the base portion 73 having a curvature in plan view (XY plane view). One end of each moving blade 74 is positioned on an outer peripheral edge of the base portion 73. The other end of each moving blade 74 is positioned further on the inner side than the outer peripheral edge of the base portion 73 in the radial direction.

That is to say, the end portions of each of the first moving blades 74*a*, the second moving blades 74*b*, and the third moving blades 74*c*, at the outer side in the radial direction, are all positioned on the outer edge of the base portion 73. On the other hand, end portions P1 of the first moving blades 74*a* on the inner peripheral side are positioned closest to the center of the base portion 73. End portions P2 of the second moving blades 74*b* on the inner peripheral side are positioned on the outer side in the radial direction from the end portions P1 of the first moving blades 74*a*. End portions P3 of the third moving blades 74*c* on the inner peripheral side are positioned further on the outer side in the radial direction from the end portions P2 of the second moving blades 74*b*. This configuration enables turbulence within the impeller 70 to be reduced, so the air blowing efficiency of the impeller 70 is improved.

The first moving blades 74*a*, the second moving blades 74*b*, and the third moving blades 74*c*, each have a shape that is curved like a bow in a counterclockwise direction.

The first moving blades 74*a* are each formed of four arcs that are different in radius of curvature. A projecting blade face 74*d* of the first moving blades 74*a* has three inflection points CP11, CP12, and CP13, in the longitudinal direction.

The second moving blades 74*b* are each formed of three arcs that are different in radius of curvature. A projecting blade face 74*e* of the second moving blades 74*b* has two inflection points CP21 and CP22 in the longitudinal direction.

The third moving blades 74*c* are each formed of two arcs that are different in radius of curvature. A projecting blade face 74*f* of the third moving blades 74*c* has one inflection point CP31 in the longitudinal direction.

In the present embodiment, the inflection point CP11 of each first moving blade 74*a*, the inflection point CP21 of each second moving blade 74*b*, and the inflection point CP31 of each third moving blade 74*c*, are each disposed at the same radius position C1 on the base portion 73. Further, the radius of curvature of a portion of each first moving blade 74*a* that is further on the outer side of the radial position C1, the radius of curvature of a portion of each second moving blade 74*b* that is further on the outer side of the radial position C1, and the radius of curvature of a portion of each third moving blade 74*c* that is further on the outer side of the radial position C1, are the same as each other.

Next, the inflection point CP12 of each first moving blade 74*a*, the inflection point CP22 of each second moving blade 74*b*, and the end portion P3 of each third moving blade 74*c* are each disposed at the same radius position C2 on the base portion 73. Further, the radius of curvature of a portion of each first moving blade 74*a* between the radial positions C1 and C2, the radius of curvature of a portion of each second moving blade 74*b* between the radial positions C1 and C2, and the radius of curvature of a portion of each third moving blade 74*c* between the radial positions C1 and C2, are the same as each other.

Next, the inflection point CP13 of each first moving blade 74*a* and the end portion P2 of each second moving blade 74*b* are disposed at the same radius position C3 on the base portion 73. Further, the radius of curvature of a portion of each first moving blade 74*a* between the radial positions C2 and C3 and the radius of curvature of a portion of each second moving blade 74*b* between the radial positions C2 and C3 are the same as each other.

The radii of curvature of the blade faces 74*d* to 74*f* of the moving blades 74 (74*a* through 74*c*) in the present embodiment are different for each region of the impeller 70 in the radial direction. Meanwhile, portions of different types of moving blades (the first moving blades 74*a* through third moving blades 74*c*) that belong to the same region in the radial direction are set to have the same radius of curvature.

In the present embodiment, the radial position C3 agrees with the intake port 80*a* of the impeller housing 80 as seen in the axial direction. Accordingly, only the portions of the first moving blades 74*a* further on the inner peripheral side than the inflection point CP13 are disposed inward of the intake port 80*a*.

The impeller hub 72 includes a cylindrical portion 72*a* that extends in the axial direction, a disc-shaped flange portion 72*b* that extends outwards in the radial direction from the lower portion of the outer peripheral face of the cylindrical portion 72*a*, and multiple projecting portions 72*c* that protrude upwards from the upper face of the flange portion 72*b*. The cylindrical portion 72*a* includes a tapered inclined face portion 72*d* that becomes tapered toward the tip portion at the upper side.

The impeller hub 72 is attached to the impeller main body 71 by inserting the cylindrical portion 72*a* into the through hole 73*a* of the base portion 73 from the lower side. The cylindrical portion 72*a* may be press-fitted into the through hole 73*a*, or may be fixed using an adhesive agent or the like. The flange portion 72*b* of the impeller hub 72 supports the impeller main body 71 from the lower side. The projecting portions 72*c* on the flange portion 72*b* are fitted into recesses 73*c* on the lower face of the base portion 73. Fitting the projecting portions 72*c* into the recesses 73*c* restricts relative movement of the impeller main body 71 and the impeller hub 72 in the circumferential direction.

Due to the impeller hub 72 including the flange portion 72*b*, the flange portion 72*b* can support the impeller main body 71 over a wide area in the radial direction from below. Accordingly, the impeller 70 can be held in a stable manner, and stability at the time of high-speed rotation is raised. That is to say, the flange portion 72*b* can support the impeller main body 71 over a wide area in the radial direction from below, so deviation as to the shaft 31 of the impeller 70 can be reduced.

The inclined face portion 72*d* at the tip of the cylindrical portion 72*a* of the impeller hub 72 and the inclined face portion 73*b* of the base portion 73 are smoothly connected to each other in the vertical direction in the impeller 70. The inclined face portion 72*d* and the inclined face portion 73*b* make up a ring-shaped inclined face 70*b* that guides fluid suctioned from the intake port 70*a* of the impeller 70 to the outer side in the radial direction.

Configuring the ring-shaped inclined face 70*b* from the impeller main body 71 and the impeller hub 72 enables the maximum height of the ring-shaped inclined face 70*b* to be increased by increasing the length of the cylindrical portion 72*a* (inclined face portion 72*d*) without increasing the height of the inclined face portion 73*b* of the base portion 73. Accordingly, a ring-shaped inclined face 70*b* having a preferable shape can be realized while suppressing increase in thickness of the base portion 73.

The impeller hub 72 is preferably made of metal. In this case, the shaft 31 and the impeller 70 can be strongly linked to each other. Accordingly, the impeller 70 can be rotated at high speeds in a stable manner. Moreover, a metal face can be used as the inclined face portion 72*d*, and accordingly the surface of the upper tip of the ring-shaped inclined face 70*b* can be smoothed.

The impeller 70 is fixed to the shaft 31 by fitting the upper end portion of the shaft 31 into the cylindrical portion 72*a* of the impeller hub 72 from the lower side. As illustrated in FIG. 1 and FIG. 9, the impeller 70 connected to the shaft 31 is disposed at the inner side of the ring-shaped protruding portion 66*c* of the ring-shaped cover portion 61*b*. Accordingly, the protruding portion 66*c* is disposed nearby a vent 70*c* of the impeller 70.

The protruding portion 66*c* guides exhaust air discharged from the impeller 70 to the lower side, along with a later-described exhaust air guide 83 of the impeller housing 80. In the present embodiment, the outer peripheral face of the protruding portion 66*c* is an inclined face 66*e* that is progressively inclined downwards toward on the outer side in the radial direction. The outer peripheral face of the protruding portion 66*c* is a smooth convex curved shape toward the outer side.

The lower end of the outer peripheral face of the protruding portion 66*c* is smoothly connected to the outer peripheral face of the cylindrical upper-portion stator vane supporting ring 66*b*. Accordingly, the inclination angle as to the horizontal direction at the lower end of the protruding portion 66*c* is approximately 90°. The upper end of the protruding portion 66*c* is positioned on the immediately outer side in the radial direction of the outer peripheral edge of the base portion 73 of the impeller 70. The upper end of the protruding portion 66*c* is positioned at the upper side from the lower face of the base portion 73, but is positioned at the lower side from the upper face of the outer peripheral edge of the base portion 73.

In the air blowing device 1 according to the present embodiment, air discharged from the impeller 70 can be smoothly guided downwards without turbulence in the flow, due to the protruding portion 66*c* having the above-described shape and placement. At the lower end of the vent 70*c* of the impeller 70, air is discharged from the outer peripheral edge of the base portion 73 in an approximately horizontal direction. The upper end of the protruding portion 66*c* is at a position lower than the upper face of the base portion 73 in the present embodiment, so the discharged air is guided following the outer peripheral face of the protruding portion 66*c* without colliding with the protruding portion 66*c*. Accordingly, air can be conveyed efficiently. Also, providing the protruding portion 66*c* enables air that has been emitted to the outer side in the radial direction from the vent 70*c* to flow into the gap in the axial direction between the ring-shaped cover portion 61*b* and base portion 73.

The impeller housing 80 has the intake port 80*a* on the upper side, and has the shape of a cylinder that is tapered toward the upper side in the axial direction. The impeller housing 80 has an intake guide portion 81 positioned at the opening end of the intake port 80*a*, an impeller housing main body 82 that accommodates the impeller 70, and a skirt-like exhaust air guide portion 83 that extends from the outer peripheral edge of the impeller housing main body 82 toward in the radial direction and downwards.

The impeller housing main body 82 has a cross-sectional shape modeled after that of the shroud 75 of the impeller 70. The inner face (lower face) of the impeller housing main body 82 faces the outer face (upper face) of the shroud 75 across a uniform spacing.

The ring-shaped intake guide portion 81 that protrudes toward the inner side in the radial direction is positioned on the upper end of portion the inner peripheral side of the impeller housing main body 82. The intake guide portion 81 covers an upper end face 75*b* of the shroud 75 from above, as illustrated in FIG. 9. A narrow gap runs in the radial direction between the lower face of the intake guide portion 81 and the upper end face 75*a* of the shroud 75.

An outer-peripheral-side end portion 82*a* of the impeller housing main body 82 is bent to wrap around the outer peripheral end of the shroud 75 to the lower side. A narrow gap extending to the upper side in the axial direction runs between the inner peripheral face of the outer-peripheral-side end portion 82*a* and the outer side end face of the shroud 75.

The exhaust air guide portion 83 has a stepped portion 83*a* at the lower face that extends the full circumference on the inner side in the radial direction. The stepped portion 83*a* is fit into a stepped portion 65*a* of the outer perimeter ring 65 of the ring-shaped cover portion 61*b*, as illustrated in FIG. 9. The inner peripheral face of the exhaust air guide portion 83 and the inner peripheral face of the outer perimeter ring 65 are smoothly connected in the vertical direction, making up a wall face on the outer peripheral side of the exhaust air flow path.

The inner peripheral face of the exhaust air guide portion 83, along with the outer peripheral face of the protruding portion 66*c* of the ring-shaped cover portion 61*b* situated at the lower side of the impeller 70, makes up an exhaust air flow path 92 that guides exhaust air, discharged to the outer side in the radial direction from the impeller 70, to the lower side. The exhaust air guide portion 83 has a guide-portion inner-side recessed portion 83*b* and a guide-portion outer-side protruding portion 83*c*. The guide-portion inner-side recessed portion 83*b* is a portion where the inner peripheral face is recessed. The guide-portion inner-side protruding portion 83*c* is a portion situated at the lower side from the guide-portion inner-side recessed portion 83*b* and where the inner peripheral face bulges. The distance between the inclined face 66*e* and the inner peripheral face of the exhaust air guide portion 83 is the shortest at the region where the guide-portion inner-side protruding portion 83*c* and the inclined face 66*e* face each other. Accordingly, the efficiency of the air blowing device 1 is improved. That is to say, when air is discharged to the outer side in the radial direction by the impeller 70, the air passes through the region where the distance between the inclined face 66*e* and the inner peripheral face of the exhaust air guide portion 83 is the shortest. The cross-sectional are of the flow path is locally narrow at this region, so static pressure of the airflow rises in this region, and separation of airflow at the inner peripheral face of the exhaust air guide portion 83 and at the inclined face 66*e* is reduced. Accordingly, occurrence of turbulence within the flow path formed between the inclined face 66*e* and the inner peripheral face of the exhaust air guide portion 83 is suppressed, and air can be efficiently guided within the flow path, so the efficiency of the air blowing device 1 can be improved.

The exhaust air flow path 92 is connected to the exhaust air flow path 93 of the stator vane member 60, as illustrated in FIG. 9. The exhaust air flow path 93 of the stator vane member 60 is made up of flow paths between the upper-portion stator vanes 67*a* and flow paths between the lower-portion stator vanes 67*b*, as illustrated in FIG. 10. The portions where the exhaust air flow path 93 connects to the outside are the vents 95.

The air blowing device 1 according to the present embodiment draws air into the impeller 70 from the intake 80*a* by rotating the impeller 70 by the motor 10, and discharges air to the outer side in the radial direction via air flow paths within the impeller 70, as illustrated in FIG. 1. The exhaust air discharged from the impeller 70 passes through the exhaust air flow path 92 and flows in between the upper-portion stator vanes 67*a*. The upper-portion stator vanes 67*a* rectify and discharge the exhaust air downwards. The lower-portion stator vanes 67*b* guides the exhaust air to the outer side in the radial direction, while directing the flow direction downwards. Thereafter, the exhaust air is externally discharged from the air blowing device 1 through the vents 95.

Part of the exhaust air discharged downwards from the vents 95 follows the outer peripheral face of the housing 20 of the motor 10 and flows to the lower side. Another part of the exhaust air discharged from the vents 95 flows into the inside of the motor 10 from the housing-upper-portion through holes 25 and 26 provided to the housing 20.

Part of the exhaust air that has flowed into the motor 10 via the housing-upper-portion through holes 25 flows into the air flow paths FP between the stator 40 and housing 20 illustrated in FIG. 6. The exhaust air flows downstream through the flow paths FP. The outer peripheral faces of the linear portions 41*c* (stator core 41) are exposed within the flow paths FP as illustrated in FIG. 4, and are cooled by the exhaust air. Multiple plate portions 45 are situated within the air flow paths FP, and rectify the exhaust air flowing through the flow paths FP. According to this configuration, the blowing efficiency of the exhaust air flowing through the air flow paths FP is improved. The exhaust air that has flowed through the air flow paths FP is discharged downwards from the lower-side openings 24 of the motor 10.

Part of the exhaust air that has flowed into the motor 10 via the housing-upper-portion through holes 26 flows to the inner side of the stator 40 via the gaps CL, as illustrated in FIG. 6. The first side end face 43*b* and second side end face 43*c* and the inclined member 46 making up the gaps CL guide the exhaust air passing through the gaps CL to the side faces of the coils 42. That is to say, a situation where the exhaust air passing through the gaps CL strikes the upper face of the arc portions 41*d* and reduces exhaust efficiency can be reduced as compared with a case where no inclined member 46 is provided. According to this configuration, the coils 42, which are heat generators in the motor 10, can be efficiently cooled. The exhaust air flows downwards around the coils 42, and is emitted downwards from the through holes 22*a* at the lower face of the motor 10.

In the air blowing device 1 according to the present embodiment, the vents 95 that are ring shaped around the axis are disposed above the motor 10. Accordingly, there is no need to provide air flow path members for exhausting to the motor 10 on the outer peripheral side in the radial direction. As a result, a motor 10 having a larger diameter can be used, and the air blowing capabilities of the air blowing device 1 can be improved without increasing the diameter thereof. Alternatively, the size of the air blowing device 1 can be reduced while maintaining the same air blowing capabilities.

It is sufficient for the vent 95 to be situated further upwards from the stator 40. The relationship between the capabilities of the motor 10 and the diameter is decided by the size of the stator 40, so the vents 95 can be disposed on the inner side of the diameter of the motor 10 as long as the vents 95 are disposed further upwards from the stator 40.

The air blowing device 1 according to the present embodiment has three gaps CL and three air flow paths FP. According to this configuration, the stator core 41 and coils 42 can be efficiently cooled by air flowing in to the inner side in the radial direction from the gaps CL, and the stator core 41 can be cooled by air flowing through the flow paths FP in the axial direction.

Although an exemplary embodiment of the present disclosure has been described above, the present disclosure is not restricted to the above embodiment.

Figure 12:
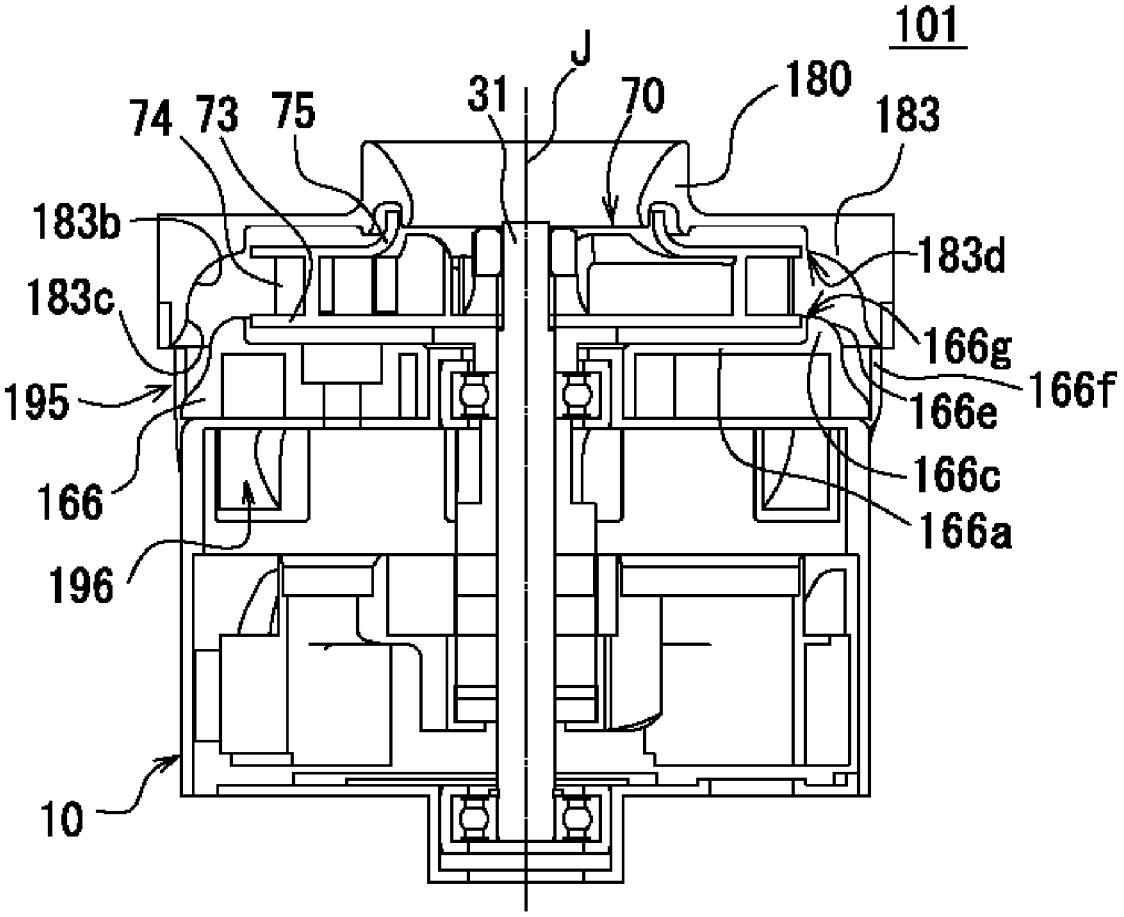
FIG. 12 is a longitudinal-section view of an air blowing device according to a second embodiment.

FIG. 12 is a longitudinal-section view of an air blowing device 101 according to an exemplary second embodiment. In the present embodiment, components that are the same as those in the above-described embodiment are denoted by the same reference symbols, and description thereof will be omitted.

The air blowing device 101 has the motor 10, a ring-shaped cover portion 166, the impeller 70, and an impeller housing 180. The motor 10 has the shaft 31 disposed following the central axis J extending in the vertical direction. The outer edge of the motor 10 in the radial direction is situated further to the outer side in the radial direction as compared to the outer edge of the impeller 70 in the radial direction.

The impeller 70 is fixed to the shaft 31. The impeller 70 has the base portion 73, the shroud 75, and the multiple moving blades 74. The base portion 73 is a flat plate-shaped member that extends in a direction orthogonal to the shaft 31. The shroud 75 is positioned above the base portion 73 and opens upwards. The multiple moving blades 74 are connected to the base portion 73 and the shroud 75, and are arrayed in the circumferential direction.

The impeller housing 180 encompasses an upper side and the outer side of the impeller 70 in the radial direction. The impeller housing 180 includes an exhaust air guide portion 183. The exhaust air guide portion 183 extends outwards in the radial direction and downwards being positioned outward of the outer edge of the impeller 70 in the radial direction. The impeller housing 180 includes a vent 195 at the upper side from the lower end portion of the ring-shaped cover portion 166. Therefore, in a case where the vent 195 is positioned at the upper side from the motor 10, air blowing efficiency of the air blowing device 101 can be improved even in a case where the length of a flow path configured between a later-described inclined face 166*e* and the inner peripheral face of the exhaust air guide portion 183 is short. That is to say, a region can be configured in the flow path where the cross-sectional area of the flow path becomes locally small, so static pressure of the airflow rises in this region, and occurrence of turbulence due to separation of air in the flow path can be reduced.

The ring-shaped cover portion 166 is positioned at the upper side from the motor 10 in the axial direction. The ring-shaped cover portion 166 includes a ring-shaped cover flat face portion 166*a* and a protruding portion 166*c*. The ring-shaped cover flat face portion 166*a* extends in a direction orthogonal to the shaft 31 and faces the base portion 73 in the axial direction. The protruding portion 166*c* protrudes upwards from the ring-shaped cover flat face portion 166*a*, further on the outer side of the outer edge of the impeller 70 in the radial direction. The protruding portion 166*c* has the inclined face 166*e*. The inclined face 166*e* progressively inclines downwards as the outer peripheral face heads toward the outer side in the radial direction.

The position of the inner edge of the protruding portion 166*c* in the radial direction, and the position of the inner edge of the exhaust air guide portion 183 in the radial direction, are the same. That is to say, the exhaust air guide portion 183 smoothly curves toward the outer side in the radial direction and downwards, from the inner end toward the outer side. The inclined face 166*e* of the protruding portion 166*c* also smoothly curves toward the outer side in the radial direction and downwards from the inner end toward the outer side. Thus, air discharged from the impeller is smoothly guided to the outer side in the radial direction and downwards, by the exhaust air guide portion 183 and the inclined face 166*e*. Accordingly, occurrence of air turbulence can be reduced near the inner peripheral face of the impeller housing 180 and near the inclined face 166*e*, so the air blowing efficiency of the air blowing device 101 is improved.

The exhaust air guide portion 183 includes a guide-portion inner-side recessed portion 183*b* and a guide-portion inner-side protruding portion 183*c*. The guide-portion inner-side recessed portion 183*b* is a portion of which the inner peripheral face is recessed. The guide-portion inner-side protruding portion 183*c* is positioned at the lower side from the guide-portion inner-side recessed portion 183*b*, and is a portion of which the inner peripheral face bulges. The distance between the inclined face 166*e* and the inner peripheral face of the exhaust air guide portion 183 is shortest at a region in which the guide-portion inner-side protruding portion 183*c* and the inclined face 166*e* face each other. Accordingly, the efficiency of the air blowing device 101 is improved. That is to say, when air is discharged to the outer side in the radial direction by the impeller 70, the air passes through a region where the distance between the inclined face 166*e* and the inner peripheral face of the exhaust air guide portion 183 is shortest. In this region, the sectional area of the flow path is locally small, so static pressure becomes high and thus separation of air flow at the inner peripheral face of the exhaust air guide portion 183 and the inclined face 166*e* is reduced. Accordingly, occurrence of turbulence in the flow path configured between the inclined face 166*e* and the inner peripheral face of the exhaust air guide portion 183 is reduced, and effective guidance in the flow path can be performed, so the efficiency of the air blowing device 101 is improved.

The air blowing device 101 includes an inward vent 196. The vent 195 and the inward vent 196 are alternately disposed in the circumferential direction. Part of air discharged toward the outer side in the radial direction by the impeller 70 passes through the flow path and is discharged toward the outer side in the radial direction via the vent 195. Meanwhile, another part of the air discharged toward the outer side in the radial direction by the impeller 70 passes through the flow path and is guided into the inner side of the motor 10 via the inward vent 196.

The ring-shaped cover portion 166 includes a ring-shaped cover connection portion 166*f* between the vent 195 and the inward vent 196. At least part of the ring-shaped cover connection portion 166*f* is fixed. That is to say, at least part of the impeller housing 180 and at least part of the ring-shaped cover portion 166 are fixed. Accordingly, the impeller housing 180 and the ring-shaped cover portion 166 can be assembled with high precision. That is to say, the positional relationship between the inner peripheral face of the impeller housing 180 and the ring-shaped cover portion 166 can be managed in a highly precise manner. Accordingly, the sectional area of the flow path configured between the inner peripheral face of the impeller housing 180 and the inclined face 166*e* can be configured with high precision, so occurrence of uneven air pressure in the flow path can be reduced. Also, vibrations of the impeller housing 180 can be reduced.

Figure 13:
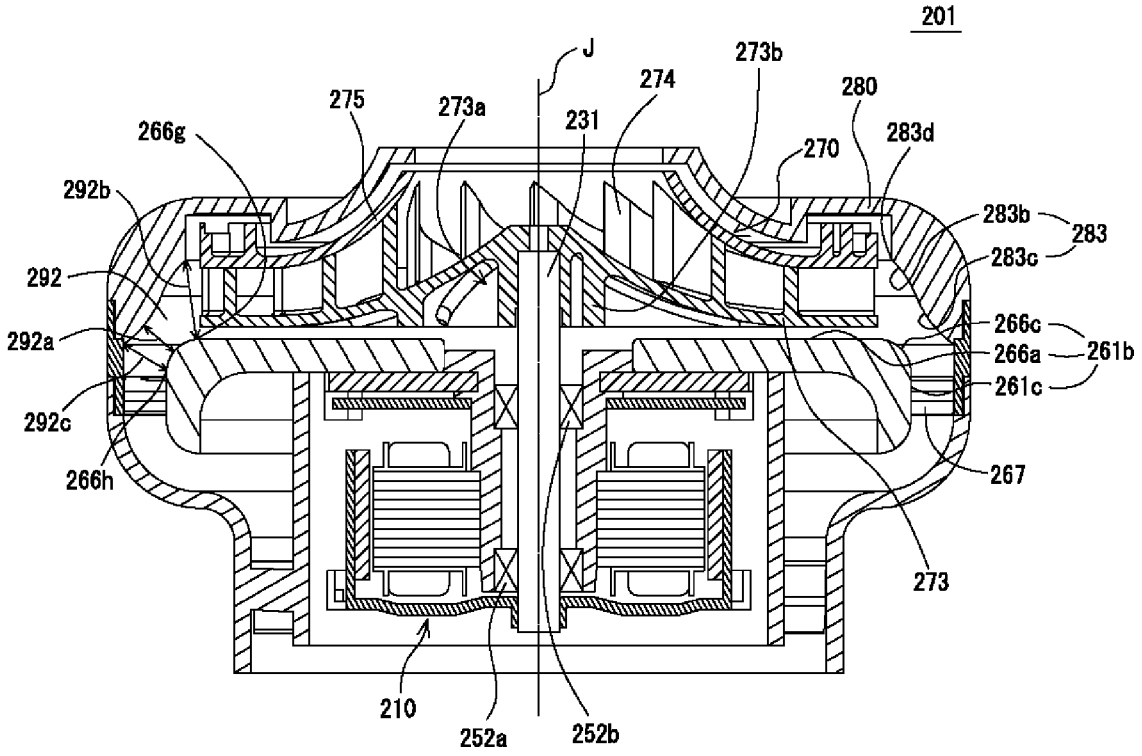
FIG. 13 is a longitudinal-section view of an air blowing device according to a third embodiment.

FIG. 13 is a longitudinal-section view of an air blowing device 201 according to an exemplary third embodiment of the present disclosure. Components of the air blowing device 201 according to the third embodiment that are the same as those of the above-described air blowing device 1 or air blowing device 101 may be denoted by the same reference symbols, and description thereof may be omitted.

The air blowing device 201 has a motor 210, a ring-shaped cover 261*b*, an impeller 270, and an impeller housing 280. The motor 210 has a shaft 231 that is disposed following the central axis J extending in the vertical direction. The motor 210 is an outer rotor type, but may be an inner rotor type.

The impeller 270 is fixed to the shaft 231. The impeller 270 is rotatably supported on the central axis J by a lower-side bearing 252*a* and upper-side bearing 252*b*. The impeller 270 has a base portion 273 and moving blades 274. The base portion 273 extends in a direction intersecting the shaft 231. Note however, that a member of the base portion 273 at the outer side in the radial direction has a plate-like form extending in a direction orthogonal to the shaft 231, and a member on the inner side in the radial direction is an inclined face that smoothly spreads toward the lower side in the radial direction, the farther away from the inner side toward the outer side. Accordingly, the fluid emitted by the impeller 270 can be smoothly guided to the outer side in the radial direction. Note that the entire base portion 273 may have a plate-like form extending in a direction orthogonal to the shaft 231, or the entirety may be a curved face that smoothly spreads toward the lower side in the radial direction, the farther away from the inner side toward the outer side. Multiple moving blades 274 are connected to the base portion 273 and arrayed in the peripheral direction. The moving blades 274 may be formed as an integral member with the base portion 273, or may be formed as separate members.

The impeller housing 280 encompasses above the impeller 270 and the outer side thereof in the radial direction. The impeller housing 280 has an exhaust air guide portion 283 that extends toward the outer side in the radial direction and downwards, further on the outer side from the outer edge of the impeller 270 in the radial direction. The exhaust air guide portion 283 has a guide-portion inner-side recessed portion 283*b* and a guide-portion inner-side protruding portion 283*c*. The guide-portion inner-side recessed portion 283*b* is a portion where the inner face is recessed toward the outer side in the radial direction. A radial-direction inner end 283*d* on the inner face of the exhaust air guide portion is disposed further on the outer side from the outer edge of the impeller 270 in the radial direction. Accordingly, the guide-portion inner-side recessed portion is a member disposed further on the outer side from the outer edge of the impeller 270 in the radial direction, with the inner face thereof bulging toward the inner side in the radial direction. The guide-portion inner-side protruding portion 283*c* is a portion situated at the outer side in the radial direction and the lower side in the axial direction from the guide-portion inner-side recessed portion 283*b*.

The ring-shaped cover 261*b* is situated above the motor 210 in the axial direction. The ring-shaped cover 261*b* corresponds to the ring-shaped cover portions 61*b* and 116 in the above-described air blowing device 1 and air blowing device 101. The ring-shaped cover 261*b* has a ring-shaped cover upper face portion 266*a* and a ring-shaped cover outer edge portion 266*c*. The ring-shaped cover upper face portion 266*a* extends in a direction intersecting the shaft 231, and faces the base portion 273 in the axial direction. Note that the ring-shaped cover upper face portion 266*a* does not necessarily have to have a flat-plate-like form extending in a direction orthogonal to the shaft 231. Part of the ring-shaped cover upper face portion 266*a* may be inclined more downwards the further toward the outer side in the radial direction.

The ring-shaped cover outer edge portion 266*c* is positioned further on the outer side from the outer edge of the impeller 270 in the radial direction. The position in the radial direction of a radial direction inner edge 266*g* of the ring-shaped cover outer edge portion is at the same height in the radial direction of the ring-shaped cover upper face portion 266*a* in the present embodiment. That is to say, the ring-shaped cover outer edge portion 266*c* is a member that smoothly curves from the outer edge of the ring-shaped cover upper face portion 266*a* in the radial direction toward the outer side in the radial direction and downwards in the axial direction.

The outer face of the ring-shaped cover outer edge portion 266*c* and the inner face of the exhaust air guide portion 283 are disposed across a gap. Further, the gap configures a flow path 292 to which fluid flowing in from the impeller 270 is guided. That is to say, fluid that has been emitted from the impeller 270 is guided further to the outer side in the radial direction and downwards in the axial direction than the impeller 270 via the flow path 292. The air blowing device 201 has a first width 292*a* where the distance between the outer face of the ring-shaped cover outer edge portion 266*c* and the inner face of the exhaust air guide portion 283 is shortest, at a region further on the outer side from the radial direction inner edge 266*g* of the ring-shaped cover outer edge portion and also on the inner side from a radial-direction outer edge 266*h* of the ring-shaped cover outer edge portion. The term distance as used here means the linear distance between an optional point on the outer face of the ring-shaped cover outer edge portion 266*c* and an optional point on the inner face of the exhaust air guide portion 283. That is to say, considering an optional point on the outer face of the ring-shaped cover outer edge portion 266*c* and an optional point on the inner face of the exhaust air guide portion 283, the first width 292*a* is the length where a distance connecting these points is the shortest.

The first width 292*a* is a gap that is smaller than a flow-in opening width 292*b* where fluid flows into the gap and a flow-out opening width 292*c* where fluid flows out of the gap. That is to say, the cross-sectional area of the flow path 292 is the smallest at the region where the distance between the outer face of the ring-shaped cover outer edge portion 266*c* and the inner face of the exhaust air guide portion 283 is the first width. Accordingly, even in a case where the flow path 292 is short in length, the static pressure of fluid is temporarily raised at the outer side of the impeller 270, and turbulence can be suppressed from occurring in the fluid flowing through the flow path 292. Now, the flow-in opening width 292*b* is the distance connecting the radial direction inner edge 266*g* of the ring-shaped cover outer edge portion and a radial-direction inner edge 283*d* on the inner face of the exhaust air guide portion. In the same way, the flow-out opening width 292*c* is the distance connecting the radial-direction outer edge 266*h* of the ring-shaped cover outer edge portion and the outer edge of the exhaust air guide portion 283 in the radial direction.

Note that at least part of the outer face of the ring-shaped cover outer edge portion 266*c* may be an inclined face that spreads in the radial direction from the upper side in the axial direction toward the lower side, and the region where the gap becomes the first width 292*a*. That is to say, an arrangement where the width of the flow path 292 becomes the first width 292*a* may be realized by the outer face of the ring-shaped cover outer edge portion 266*c* spreading in the radial direction. Accordingly, the fluid within the flow path 292 can be smoothly guided by the ring-shaped cover outer edge portion 266*c*, and also the static pressure of the fluid can be increased.

In further detail, the width of the gap is the first width 292*a* at the region where the guide-portion inner-side protruding portion 283*c* and the ring-shaped cover outer edge portion 266*c* face each other. That is to say, the cross-sectional area of the flow path 292 is the smallest at the region where the guide-portion inner-side protruding portion 283*c* and the ring-shaped cover outer edge portion 266*c* face each other. Accordingly, the guide-portion inner-side protruding portion 283*c* can be formed at a preferable position on the exhaust air guide portion 283, and the first width 292*a* can be formed at a preferably region of the flow path 292, so the degree of freedom in design is improved. Also, the first width 292*a* is realized by a region where the ring-shaped cover outer edge portion 266*c* protrudes outwards and a region where the exhaust air guide portion 283 protrudes inwards, so the cross-sectional area of the flow path 292 can be further reduced, and the static pressure within the flow path 292 can be further raised.

The ring-shaped cover 261*b* has a ring-shaped cover outer peripheral portion 261*c* that extends downwards in the radial direction from the ring-shaped cover outer edge portion 266*c*. The ring-shaped cover outer peripheral portion 261*c* is a cylindrical member where the outer face is generally cylindrical. Multiple stator vanes 267 are disposed on the outer face of the ring-shaped cover outer peripheral portion 261*c* in the radial direction, following the peripheral direction. Accordingly, the fluid that flows through the flow path 292 and downwards at the outer side of the ring-shaped cover outer peripheral portion 261*c* can be guided smoothly. The number of the stator vanes 267 and the number of the above-described moving blades 274 are preferably coprime integers. This can suppress resonance from occurring between the stator vanes 267 and moving blades 274 and noise increasing when the impeller 270 rotates.

Note that the ring-shaped cover outer edge portion 266*c* may protrude farther upwards than the ring-shaped cover upper face portion 266*a*. Accordingly, fluid discharged from the impeller 270 can be smoothly guided. The fluid discharged from the impeller 270 can also be suppressed from flowing between the base portion 273 and the ring-shaped cover upper face portion 266*a*, and reducing air-blowing efficiency of the air blowing device 201. The radial-direction inner edges of the base portion 273 and the ring-shaped cover outer edge portion 266*c* face each other in the radial direction. The upper end of the ring-shaped cover outer edge portion 266*c* preferably is disposed below the upper face of the base portion 273 at the outer edge in the radial direction. Accordingly, the upper end of the ring-shaped cover outer edge portion 266*c* can be prevented from protruding upwards beyond the upper face of the base portion 273, even in cases where there is assembly error of the impeller 270 or the radial-direction outer side of the impeller 270 slightly deviates in the vertical direction when the impeller 270 rotates. Accordingly, the fluid that has been discharged from the impeller 270 can be suppressed from colliding into the ring-shaped cover outer edge portion 266*c*, so the air-blowing efficiency of the air blowing device 201 can be suppressed from deteriorating.

In the present embodiment, the impeller 270 is disposed above the base portion 273, and has a shroud 275 connected with the multiple moving blades 74. The radial-direction inner edge 283*d* on the inner face of the exhaust air guide portion is disposed further to the upper side than the lower face of the radial-direction outer edge of the shroud 275. Accordingly, the radial-direction inner edge 283*d* on the inner face of the exhaust air guide portion can be suppressed from protruding further to the lower side than the lower face of the shroud 275, even in cases where there is assembly error of the impeller 270 or the radial-direction outer side of the impeller 270 slightly deviates in the vertical direction when the impeller 270 rotates. Accordingly, the fluid that has been discharged from the impeller 270 can be suppressed from colliding into the radial-direction inner edge 283*d* of the exhaust air guide portion, so the air-blowing efficiency of the air blowing device 201 can be suppressed from deteriorating.

Figure 14:
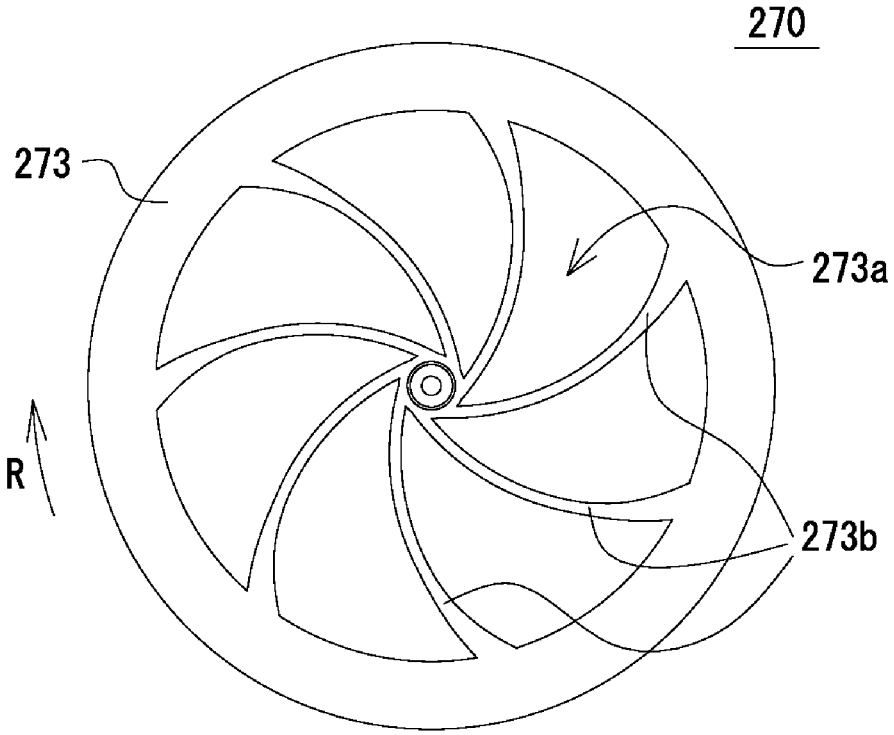
FIG. 14 is a bottom view of an impeller according to the third embodiment.

FIG. 14 is a bottom view of the impeller 270 according to the exemplary third embodiment of the present disclosure. The lower face of the base portion 273 has a base-portion recessed portion 273*a* that is progressively recessed upwards toward the inner side in the radial direction, as illustrated in FIG. 13 and FIG. 14. The upper face of the base portion 273 is a curved face of which the position in the axial direction smoothly and progressively becomes lower from the inner side in the radial direction toward the outer side. Accordingly, in a case where the base portion 273 is formed from a resin material for example, the thickness of the base portion 273 in the axial direction will be great at the region to the inner side in the radial direction, so sink marks may occur when molding the resin. However, forming the base-portion recessed portion 273*a* at the lower face of the base portion 273 can suppress sink marks from occurring when molding the base portion 273. Also, forming the base-portion recessed portion 273*a* enables the weight of the base portion 273 to be reduced regardless of the material of the base portion 273, so material costs can be reduced, and also the rotation speed of the impeller 270 can be raised more readily.

Multiple ribs 273*b* are disposed in the base-portion recessed portion 273*a* in the peripheral direction. Thus, the rigidity of the base portion 273 can be improved. Although the multiple ribs 273*b* are disposed extending from the center of the base portion 273 toward the outer side, the layout of the ribs 273*b* is not restricted to a generally radial pattern. For example, the multiple ribs 273*b* may be disposed concentrically as to the center of the base portion 273.

The outer ends of the ribs 273*b* in the radial direction are disposed at a rearward side in the rotational direction R of the impeller, as compared to the inner ends of the ribs 273*b* in the radial direction. Accordingly, when the impeller 270 rotates, the ribs 273*b* serve to discharge the fluid between the base portion 273 and the ring-shaped cover upper face portion 266*a* to the outer side in the radial direction. Thus, due to the ribs 273*b* having the above-described configuration, fluid can be suppressed from flowing in between the base portion 273 and the ring-shaped cover upper face portion 266*a*. As a result, the air-blowing efficiency of the air blowing device 201 improves. The number of ribs 273*b* preferably is a prime number. Accordingly, resonance of the ribs 273*b* with other members when the impeller 270 rotates can be reduced, and noise generated by the air blowing device 201 can be reduced.

Figure 15:
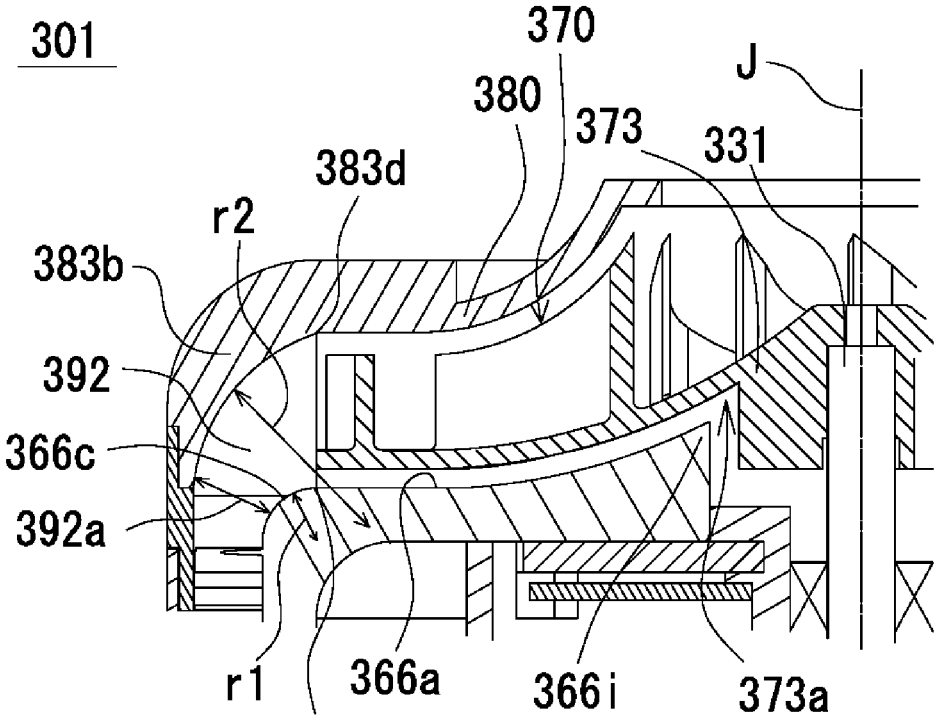
FIG. 15 is an enlarged longitudinal-section view of an air blowing device according to a fourth embodiment.

FIG. 15 is an enlarged cross-sectional view of an air blowing device 301 according to an exemplary fourth embodiment of the present disclosure. Components of the air blowing device 301 according to the fourth embodiment that are the same as those of the above-described air blowing device 1, air blowing device 101, or air blowing device 201 may be denoted by the same reference symbols, and description thereof may be omitted.

In the present embodiment, an outer face of a ring-shaped cover outer edge portion 366*c* is a curved face that bulges toward the outer side in the radial direction and the upper side in the axial direction, at a region where the gap is a first width 392*a*. An inner face of an exhaust air guide portion 383 has a guide-portion inner-side recessed portion 383*b* that is recessed toward the outer side in the radial direction and the upper side in the axial direction. Unlike the air blowing device 201, in the air blowing device 301 the exhaust air guide portion 383 has no guide-portion inner-side protruding portion. Further, a curvature radius r1 of the outer face of a ring-shaped cover outer edge portion is smaller than a curvature radius r2 of the inner face of the exhaust air guide portion. That is to say, the inner face of the exhaust air guide portion 383 curves more gradually as compared to the outer face of the ring-shaped cover outer edge portion 366*c*. Accordingly, fluid flowing through a flow path 392 is smoothly guided toward the outer side in the radial direction and the lower side in the axial direction. The gap becomes a first width 392*a* at a partial region within the flow path 392. Accordingly, the static pressure of the fluid can be increased at a partial region within the flow path 392 while smoothing the flow of the fluid.

In the present embodiment, the position in the radial direction of a radial-direction inner edge 366*g* of the ring-shaped cover outer edge portion and the position in the radial direction of a radial-direction inner edge 383*d* on the inner face of the exhaust air guide portion are the same. That is to say, the boundary region of a ring-shaped cover upper face portion 366*a* and the ring-shaped cover outer edge portion 366*c*, and a radial-direction inner edge 383*d* on the inner face of the exhaust air guide portion face each other in the axial direction. Accordingly, the flow path 392 that has a smooth curvature can be configured at the outer edge of the impeller 370, from the ring-shaped cover outer edge portion 366*c* and exhaust air guide portion 383. Thus, the air-blowing efficiency of the air blowing device 301 can be improved even further. Also, the position in the radial direction of the radial-direction inner edge 366*g* of the ring-shaped cover outer edge portion and the position in the radial direction of the outer edge of the impeller 370 in the radial direction are the same. Note that in a case where the position in the radial direction of the radial-direction inner edge 366*g* of the ring-shaped cover outer edge portion is difficult to judge, a position at the radial-direction outer side of the ring-shaped cover upper face portion 366*a* where a generally planar region changes to a smooth curved face can be taken as the radial-direction inner edge 366*g* of the ring-shaped cover outer edge portion. In the same way, in a case where the position in the radial direction of the radial-direction inner edge 383*d* on the inner face of the exhaust air guide portion is difficult to judge, a position of the inner face of the impeller housing 380 in a region near the radial-direction outer side of the impeller 370 where a generally planar region changes to a smooth curved face can be taken as the radial-direction inner edge 366*g* of the ring-shaped cover outer edge portion.

The lower face of the base portion 373 has a base-portion recessed portion 373*a* that is recessed toward the upper side in the axial direction. The ring-shaped cover upper face portion 366*a* has an inner-side protruding portion 366*i*. The inner-side protruding portion 366*i* protrudes further toward the upper side in the axial direction than the lower end of the base portion lower face, at a position further toward the inner side in the radial direction than the radial-direction outer edge of the impeller 370. The inner-side protruding portion 366*i* faces at least part of the base-portion recessed portion 373*a* across a gap in the axial direction. Accordingly, fluid that has been discharged from the impeller 370 can be suppressed from flowing in between the ring-shaped cover upper face portion 366*a* and an inner-side protruding portion 366, while forming the base-portion recessed portion 373*a* at the base portion 373.

Figure 16:
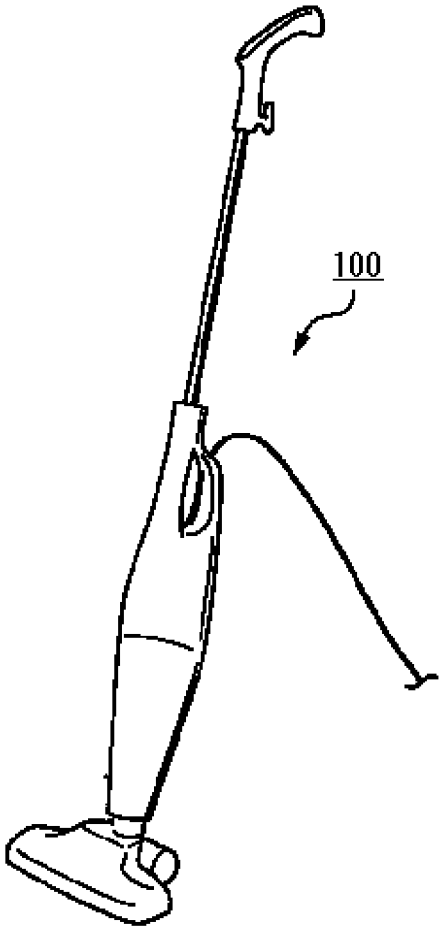
FIG. 16 is a perspective view of a vacuum cleaner.

FIG. 16 is a perspective view of a vacuum cleaner 100. The air blowing devices 1, 101, 201, and 301 according to exemplary embodiments of the present disclosure are installed in the vacuum cleaner 100, for example. Accordingly, the air blowing efficiency of the vacuum cleaner 100 is improved. Note that the air blowing devices 1, 101, 201, and 301 can be installed in other electric devices besides the vacuum cleaner 100 as well.

The air blowing device according to the present disclosure is applicable to vacuum cleaners and so forth, for example.

Features of the above-described preferred embodiments and the modifications thereof may be combined appropriately as long as no conflict arises.

While preferred embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

The invention claimed is:

1. An air blowing device, comprising:

a motor including a shaft that follows a central axis extending in a vertical direction;

a ring-shaped cover that is closer to an upper side of the air blowing device in an axial direction than the motor is;

an impeller fixed to the shaft and above the motor; and an impeller housing that encompasses above the impeller and an outer side thereof in the radial direction, wherein the impeller includes:

a base portion that extends in a direction intersecting the shaft, and a plurality of moving blades that are connected to the base portion and arrayed in a peripheral direction, the impeller housing includes an exhaust air guide portion that extends toward an outer side of the air blower device in the radial direction and toward a lower side of the air blower device, at a side further outward from the outer edge of the impeller in the radial direction, the ring-shaped cover includes:

a ring-shaped cover upper surface portion that extends in a direction intersecting the shaft, and opposes the base portion in the axial direction, and a ring-shaped cover outer edge portion that is positioned further toward the outer side of the air blower device from the outer edge of the impeller in the radial direction, an outer surface of the ring-shaped cover outer edge portion and an inner surface of the exhaust air guide portion are positioned across a gap, and the gap defines a flow path through which a fluid flowing in from the impeller is guided, the gap includes a first width where a distance between the outer surface of the ring-shaped cover outer edge portion and the inner surface of the exhaust air guide portion is shortest, in a region further towards the outer side of the air blower device from the radial-direction inner edge of the ring-shaped cover outer edge portion and further towards the inner side of the air blower device from the radial-direction outer edge of the ring-shaped cover outer edge portion, the first width is smaller than a flow-in opening width where the fluid flows into the gap and a flow-out opening width where the fluid flows out from the gap, the exhaust air guide portion includes a guide-portion inner-side recessed portion where the inner surface is recessed toward the outer side in the radial direction, and a guide-portion inner-side protruding portion situated further toward the lower side of the air blower device in the axial direction than the guide-portion inner-side recessed portion where the inner surface bulges further toward the inner side of the air blower device in the radial direction at the guide-portion inner-side protruding portion than at the guide-portion inner-side recessed portion, and a width of the gap is the first width at a region where the guide-portion inner-side protruding portion and the ring-shaped cover outer edge portion oppose each other.

2. The air blowing device according to claim 1, wherein in a region where the gap is the first width, the outer surface of the ring-shaped cover outer edge portion is a curved surface that bulges toward the outer side of the air blower device in the radial direction and the upper side of the air blower device in the axial direction, and a curvature radius of the outer surface of the ring-shaped cover outer edge portion is smaller than a curvature radius of the inner surface of the exhaust air guide portion.

3. The air blowing device according to claim 1, wherein in a region where the gap is the first width, at least a portion of the outer surface of the ring-shaped cover outer edge portion is an inclined surface that extends in the radial direction from the upper side of the air blower device in the axial direction toward the lower side of the air blower device.

4. The air blowing device according to claim 1, wherein the ring-shaped cover outer edge portion protrudes further upwards to the upper side of the air blower device than the ring-shaped cover upper surface portion.

5. The air blowing device according to claim 4, wherein the base portion and the radial-direction inner edge of the ring-shaped cover outer edge portion oppose each other in the radial direction, and the upper end of the ring-shaped cover outer edge portion is further toward the lower side of the air blower device than the upper surface of the base portion at the outer edge in the radial direction.

6. The air blowing device according to claim 1, wherein the impeller includes a shroud that is disposed further toward the upper side of the air blower device than the base portion, and is connected to the plurality of moving blades, and the radial-direction inner edge of the inner surface of the exhaust air guide portion is disposed further towards the upper side of the air blower device than the lower surface of the shroud at the radial-direction outer edge.

7. The air blowing device according to claim 1, wherein the position in the radial direction of the radial-direction inner edge of the ring-shaped cover outer edge portion and the position in the radial direction of the radial-direction inner edge of the inner surface of the exhaust air guide portion are the same.

8. The air blowing device according to claim 1, wherein the ring-shaped cover includes a ring-shaped cover outer peripheral portion that extends from the ring-shaped cover outer edge portion toward the lower side of the air blower device in the axial direction, and a plurality of stator vanes are on the radial-direction outer surface of the ring-shaped cover outer peripheral portion, along the peripheral direction.

9. The air blowing device according to claim 1, wherein the lower surface of the base portion includes base-portion recessed portion that is progressively recessed upwards toward the inner side of the air blower device in the radial direction.

10. The air blowing device according to claim 9, wherein the ring-shaped cover upper surface portion includes an inner-side protruding portion that protrudes further toward the upper side of the air blower device in the axial direction than the lower end of the base portion lower surface, at a position further toward the inner side of the air blower device in the radial direction than the radial-direction outer edge of the impeller, and the inner-side protruding portion opposes-faces at least a portion of the base-portion recessed portion across a gap in the axial direction.

11. The air blowing device according to claim 9, wherein a plurality of ribs are disposed on the base-portion recessed portion, arrayed in the peripheral direction.

12. The air blowing device according to claim 11, wherein outer ends of the ribs in the radial direction are disposed further toward at a rearward side in a rotational direction of the impeller than inner ends of the ribs in the radial direction.

13. The air blowing device according to claim 1, wherein the position in the radial direction of the protruding portion and the position in the radial direction of the inner edge of the exhaust air guide portion are the same.

14. The air blowing device according to claim 1, wherein the outer edge of the motor in the radial direction is situated further toward the outer side of the air blower device in the radial direction than the outer edge of the impeller in the radial direction, and the impeller housing includes a vent further toward the upper side of the air blower device than the lower end portion of the ring-shaped cover portion.

15. The air blowing device according to claim 1, wherein at least a portion of the impeller housing and at least a portion of the ring-shaped cover portion are fixed.

16. A vacuum cleaner, comprising the air blowing device according to claim 1.

17. The air blowing device according to claim 1, wherein a portion of an axially lower end of the guide-portion inner-side protruding portion is positioned axially above an axially upper end of the ring-shaped cover.

* * * * *